US011754940B2

(12) United States Patent
Ishida

(10) Patent No.: US 11,754,940 B2
(45) Date of Patent: Sep. 12, 2023

(54) IMAGE FORMING APPARATUS

(71) Applicant: KYOCERA Document Solutions Inc., Osaka (JP)

(72) Inventor: Hideki Ishida, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/953,870

(22) Filed: Sep. 27, 2022

(65) Prior Publication Data

US 2023/0103182 A1 Mar. 30, 2023

(30) Foreign Application Priority Data

Sep. 28, 2021 (JP) ..... 2021-158122

(51) Int. Cl.
*G03G 15/00* (2006.01)
*G03G 15/043* (2006.01)

(52) U.S. Cl.
CPC ..... *G03G 15/043* (2013.01); *G03G 15/5041* (2013.01); *G03G 15/5058* (2013.01)

(58) Field of Classification Search
CPC ..... G03G 15/043; G03G 15/5041; G03G 15/5054; G03G 15/5058
See application file for complete search history.

(56) References Cited

U.S. PATENT DOCUMENTS

| | | | | |
|---|---|---|---|---|
| 6,208,367 | B1 * | 3/2001 | Tanimoto | H04N 1/0411 347/250 |
| 2002/0063770 | A1 * | 5/2002 | Takesue | B41J 2/473 347/234 |
| 2004/0075877 | A1 | 4/2004 | Takesue | 358/250 |
| 2005/0093969 | A1 | 5/2005 | Takesue | 347/240 |

FOREIGN PATENT DOCUMENTS

| | | |
|---|---|---|
| JP | 2002-137447 A | 5/2002 |
| JP | 2012-135955 A | 7/2012 |

* cited by examiner

*Primary Examiner* — Hoang X Ngo
(74) *Attorney, Agent, or Firm* — Stein IP, LLC

(57) ABSTRACT

An image forming apparatus includes a light scanning device, a developing portion, a control portion and a storage portion. An evaluation chart includes a first evaluation pattern, a second evaluation pattern, a third evaluation pattern and a fourth evaluation pattern. The first evaluation pattern includes a first dot row and a second dot row, and the third evaluation pattern includes a fifth dot row and a sixth dot row. The fourth evaluation pattern is formed by arranging a plurality of fourth evaluation patches. The fourth evaluation patch includes a seventh dot row and an eighth dot row.

12 Claims, 27 Drawing Sheets

IMAGE FORMING APPARATUS

INCORPORATION BY REFERENCE

This application is based upon and claims the benefit of priority from the corresponding Japanese Patent Application No. 2021-158122 filed on Sep. 28, 2021, the entire contents of which are incorporated herein by reference.

BACKGROUND

The present disclosure relates to electrophotographic image forming apparatuses.

Conventionally, an electrophotographic image forming apparatus is required to increase the speed of image output and achieve a higher resolution. For these requirements, an image forming apparatus is known which adopts a multi-beam method of scanning light beams over a photoconductive drum from a multi-beam laser having a plurality of light emitters.

The image forming apparatus as described above includes a main body portion and the multi-beam laser having a plurality of light emitters which are arranged linearly at a tip of the main body portion. The image forming apparatus draws dots with light beams emitted from the light emitters to form an image with the dots. Intervals between the dots in the main scanning direction of the light beam can be adjusted by changing timing at which the light beam is emitted (timing at which each light-emitting portion is lit). Intervals between the dots in the subscanning direction (direction perpendicular to the main scanning direction) of the light beam can be adjusted by changing the rotation angle of the main body portion. Ideal timing at which the light beam is emitted is previously stored in a storage portion provided in the image forming apparatus.

Incidentally, in a conventional general image forming apparatus, dots may be displaced in a main scanning direction to cause unevenness in density or changes in density due to development characteristics, jitter produced by vibrations or the like in a conveying system such as a transfer belt or the like. To cope with this problem, the image forming apparatus as described above forms a plurality of predetermined evaluation charts, compares density differences in the evaluation charts and thereby can detect the dot displacement described above. The control portion of the image forming apparatus changes, for the detected dot displacement, timing at which each light-emitting portion emits light, and thereby can eliminate the dot displacement.

In the evaluation chart, a plurality of evaluation patches formed by dots are arranged at predetermined intervals in the main scanning direction and in the subscanning direction. The evaluation patch is formed with a first dot row and a second dot row which are linear rows of dots arranged continuously in the main scanning direction. In the first dot row and the second dot row, the number of dots in the subscanning direction is one. The second dot row is continuously connected to the downstream side of the first dot row in the subscanning direction, and is arranged to be displaced with respect to the first dot row to a downstream side in the main scanning direction.

If a dot displacement occurs in the main scanning direction, the area of a part in which the first dot row and the second dot row overlap each other in the main scanning direction is changed. Hence, an image density in the evaluation chart is changed. The timing at which each light-emitting portion emits light is adjusted according to the amount of change thereof. Correction values for the light emission timing corresponding to the image data of the evaluation chart and the size of the dot displacement are previously stored in the storage portion of the control portion.

An image forming apparatus is also provided in which, for each of a plurality of types of evaluation charts that are previously prepared, a plurality of evaluation charts are formed by intentionally displacing light emission timing by a predetermined amount, and thus the amount of dot displacement is detected. In the image forming apparatus as described above, the average value of image densities is calculated for each of the evaluation charts of the same types having different light emission timing, and an approximate curve indicating changes in the image density for the amount of dot displacement is calculated. Optimal light emission timing is determined from a peak value in the approximate curve.

SUMMARY

An image forming apparatus according to one aspect of the present disclosure includes a light scanning device, a developing portion, a control portion and a storage portion. The light scanning device includes: a light source including a plurality of light-emitting portions which are arranged at a predetermined angle with respect to a main scanning direction in a row at regular intervals; and a polygon mirror which deflects and scans light beams emitted from the light-emitting portions, and uses the light beams to form an electrostatic latent image on an image carrying member. The developing portion forms a toner image by visualizing the electrostatic latent image. The control portion controls the light scanning device such that turning on and off of each of the light-emitting portions are switched to form the electrostatic latent image corresponding to image data. The storage portion stores a predetermined evaluation chart which is formed by dots drawn with the light beams of the light-emitting portions to determine timing at which each of the light-emitting portions starts writing. The evaluation chart includes: a first evaluation pattern; a second evaluation pattern that is arranged parallel to the first evaluation pattern in the main scanning direction or a subscanning direction perpendicular to the main scanning direction; a third evaluation pattern that is arranged parallel to the first evaluation pattern in the main scanning direction or the subscanning direction; and a fourth evaluation pattern that is arranged parallel to the first evaluation pattern in the main scanning direction or the subscanning direction. The first evaluation pattern includes a first patch row that is formed by arranging a plurality of first evaluation patches at equal intervals in the subscanning direction, the first evaluation patch includes: a first dot row in which one or more dots in the subscanning direction are arranged linearly and continuously in the main scanning direction; and a second dot row in which a number of dots adjacent to the first dot row in the subscanning direction are arranged linearly and continuously in the main scanning direction so as to be displaced with respect to the first dot row, the number being equal to or less than a number obtained by subtracting a number of dots of the first dot row in the subscanning direction from a number of the light-emitting portions and a plurality of the first patch rows are arranged at predetermined equal intervals in the main scanning direction to form the first evaluation pattern. The second evaluation pattern includes a second patch row that is formed by arranging, in the subscanning direction, a plurality of second evaluation patches at same intervals as intervals at which the first evaluation patches are arranged parallel to each other, the second evaluation patch is symmetrical with the first evaluation patch in a direction in which the first evaluation pattern and the second evaluation pattern are arranged parallel to each other, and a plurality of the second patch rows are arranged at predetermined equal intervals in the main scanning direction to form the second evaluation pattern. The third evaluation pattern includes a third patch row that is formed by arranging a plurality of third evaluation patches at equal intervals in the subscanning direction, the third evaluation patch includes: a fifth dot row in which a same number of dots as in the first dot row in the subscanning direction are arranged continuously in the main scanning direction; and a sixth dot row in which a same number of dots as in the second dot row in the subscanning direction are adjacent to the fifth dot row in the subscanning direction and are arranged linearly and continuously in the main scanning direction so as to be displaced with respect to the fifth dot row and a plurality of the third patch rows are arranged at predetermined equal intervals in the main scanning direction to form the third evaluation pattern. The fourth evaluation pattern includes a fourth patch row that is formed by arranging a plurality of fourth evaluation patches at equal intervals in the subscanning direction, the fourth evaluation patch includes: a seventh dot row in which the same number of dots as in the first dot row in the subscanning direction are arranged continuously in the main scanning direction; and an eighth dot row in which the same number of dots as in the second dot row in the subscanning direction are adjacent to the seventh dot row in the subscanning direction and are arranged linearly and continuously in the main scanning direction so as to be displaced with respect to the seventh dot row and a plurality of the fourth patch rows are arranged at predetermined equal intervals in the main scanning direction to form the fourth evaluation pattern. The displacement of the sixth dot row with respect to the fifth dot row is larger or smaller than the displacement of the second dot row with respect to the first dot row by a predetermined first dot number in the main scanning direction. The displacement of the eighth dot row with respect to the seventh dot row is larger or smaller than the displacement of the fourth dot row with respect to the third dot row by the first dot number in the main scanning direction.

DETAILED DESCRIPTION

Figure 1:
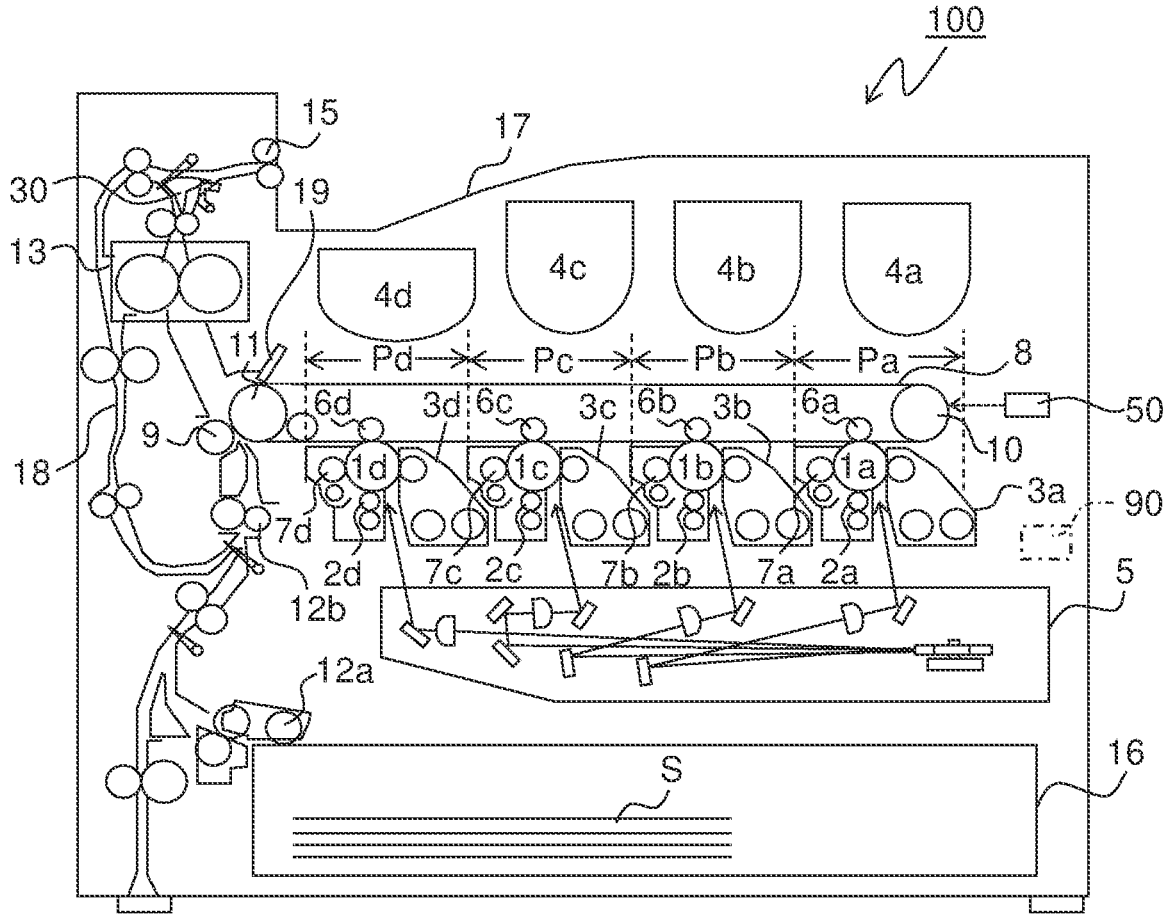
FIG. 1 is a schematic cross-sectional view showing the internal structure of an image forming apparatus according to the first embodiment of the present disclosure.

Embodiments of the present disclosure will be described below with reference to drawings. FIG. 1 is a schematic cross-sectional view showing the internal structure of an image forming apparatus 100 according to an embodiment of the present disclosure. In the main body of the image forming apparatus 100 (here, a color printer), four image forming portions Pa, Pb, Pc and Pd are provided sequentially from an upstream side in a conveying direction (a right side in FIG. 1). The image forming portions Pa to Pd are provided to correspond to images of different four colors (cyan, magenta, yellow and black), and sequentially form the images of cyan, magenta, yellow and black in the steps of charging, exposure, development and transfer.

In the image forming portions Pa to Pd, photoconductive drums 1*a*, 1*b*, 1*c* and 1*d* are provided which carry visual images (toner images) of the colors. Furthermore, an intermediate transfer belt 8 which is rotated in a clockwise direction in FIG. 1 is provided adjacent to the image forming portions Pa to Pd. The toner images formed on the photoconductive drums 1*a* to 1*d* are primarily transferred sequentially on the intermediate transfer belt 8 being moved in contact with the photoconductive drums 1*a* to 1*d* so as to be superimposed on each other. Thereafter, the toner images primarily transferred on the intermediate transfer belt 8 are secondarily transferred with a secondary transfer roller 9 on a sheet S (recording medium) serving as an example of a recording medium. Furthermore, after the toner images are fixed in a fixing device 13, the sheet S on which the toner images have been secondarily transferred is ejected from the main body of the image forming apparatus 100. While the photoconductive drums 1*a* to 1*d* are being rotated by a main motor 40 (see FIG. 4) in a counterclockwise direction in FIG. 1, an image formation process is performed on the photoconductive drums 1*a* to 1*d*.

The sheets S on which the toner images are secondarily transferred are stored in a sheet cassette 16 arranged in a lower portion of the main body of the image forming apparatus 100, and are conveyed through a paper feed roller 12*a* and a registration roller pair 12*b* to a nip portion between the secondary transfer roller 9 and the drive roller 11 of the intermediate transfer belt 8. As the intermediate transfer belt 8, a sheet formed of a dielectric resin is used, and a seamless belt is mainly used. A blade-shaped belt cleaner 19 for removing the toners and the like left on the surface of the intermediate transfer belt 8 is arranged on the downstream side of the secondary transfer roller 9.

The image forming portions Pa to Pd will then be described. Charging devices 2*a*, 2*b*, 2*c* and 2*d* for charging the photoconductive drums 1*a* to 1*d*, a light scanning device 5 for exposing image information to the photoconductive drums 1*a* to 1*d*, developing devices 3*a*, 3*b*, 3*c* and 3*d* for forming the toner images on the photoconductive drums 1*a* to 1*d*, cleaning devices 7*a*, 7*b*, 7*c* and 7*d* for removing developers (toners) and the like left on the photoconductive drums 1*a* to 1*d* and an image density sensor 50 (density detection mechanism) capable of detecting the densities of the toner images primarily transferred on the intermediate transfer belt 8 are provided around and below the photoconductive drums 1*a* to 1*d* which are rotatably provided.

When image data is input from a high-level device such as a personal computer, the charging devices 2*a* to 2*d* first uniformly charge the surfaces of the photoconductive drums 1*a* to 1*d*. Then, the light scanning device 5 applies light according to the image data to form electrostatic latent images corresponding to the image data on the photoconductive drums 1*a* to 1*d*. The developing devices 3*a* to 3*d* are respectively filled with predetermined amounts of two-component developers including the toners of the colors of cyan, magenta, yellow and black. When the ratios of the toners in the two-component developers filled in the developing devices 3*a* to 3*d* fall below specified values by the formation of the toner image to be described later, the developing devices 3*a* to 3*d* are replenished with the toners from toner containers 4*a* to 4*d*. The toners in the developers are supplied by the developing devices 3*a* to 3*d* on the photoconductive drums 1*a* to 1*d* and are electrostatically adhered thereon. In this way, toner images corresponding to the electrostatic latent images formed by exposure from the light scanning device 5 are formed.

Then, by primary transfer rollers 6*a* to 6*d*, an electric field is applied at a predetermined transfer voltage between the primary transfer rollers 6*a* to 6*d* and the photoconductive drums 1*a* to 1*d*, and thus the toner images of cyan, magenta, yellow and black on the photoconductive drums 1*a* to 1*d* are primarily transferred on the intermediate transfer belt 8. The images of the four colors are formed with a predetermined positional relationship in order to form a predetermined full-color image. Thereafter, in preparation for the subsequent formation of new electrostatic latent images, the toners and the like left on the surfaces of the photoconductive drums 1*a* to 1*d* after the primary transfer are removed by the cleaning devices 7*a* to 7*c*.

The intermediate transfer belt 8 is placed over a driven roller 10 on an upstream side and a drive roller 11 on a downstream side, and when the intermediate transfer belt 8 starts to be rotated in the clockwise direction as the drive roller 11 is rotated by a belt drive motor 51 (see FIG. 4), the sheet S is conveyed with predetermined timing from the registration roller pair 12*b* to the nip portion (secondary transfer nip portion) between the drive roller 11 and the secondary transfer roller 9 provided adjacent thereto, and the full-color image on the intermediate transfer belt 8 is secondarily transferred on the sheet S. The sheet S on which the toner images have been secondarily transferred is conveyed to the fixing device 13.

The image density sensor 50 is arranged opposite the driven roller 10 through the intermediate transfer belt 8. The image density sensor 50 is, for example, a specular reflection-type sensor which detects reflected light. The image density sensor 50 includes: an LED light source which is arranged to be inclined at a predetermined angle with respect to a detection position on the surface of the intermediate transfer belt 8; a phototransistor serving as a light-receiving element; and the like (not shown). The LED light source applies light to the toner images on the intermediate transfer belt 8, the amount of reflected light is detected by the phototransistor and thus the optical densities (hereinafter simply referred to as "image densities") of the toner images are measured. The image density sensor 50 converts the results of the measurement into electrical signals and outputs them to a control portion 90 which will be described later. The image density sensor 50 is preferably a sensor which can detect the density information of the toner images, and may be, for example, a sensor which can detect a density from an image acquired by imaging the toner images.

The sheet S which has been conveyed to the fixing device 13 is heated and pressurized with a fixing belt 21 (first fixing member) and a pressure roller 22 (second fixing member) such that the toner images are fixed on the surface of the sheet S. and thus the predetermined full-color image is formed. For the sheet S on which the full-color image has been formed, the conveying direction is distributed by a branch portion 30 which branches in a plurality of directions, and the sheet S is ejected by an ejection roller pair 15 to an ejection tray 17 without being processed (or after the sheet S is fed to a double-sided conveyance path 18 and images are formed on both the surfaces thereof).

Figure 2:
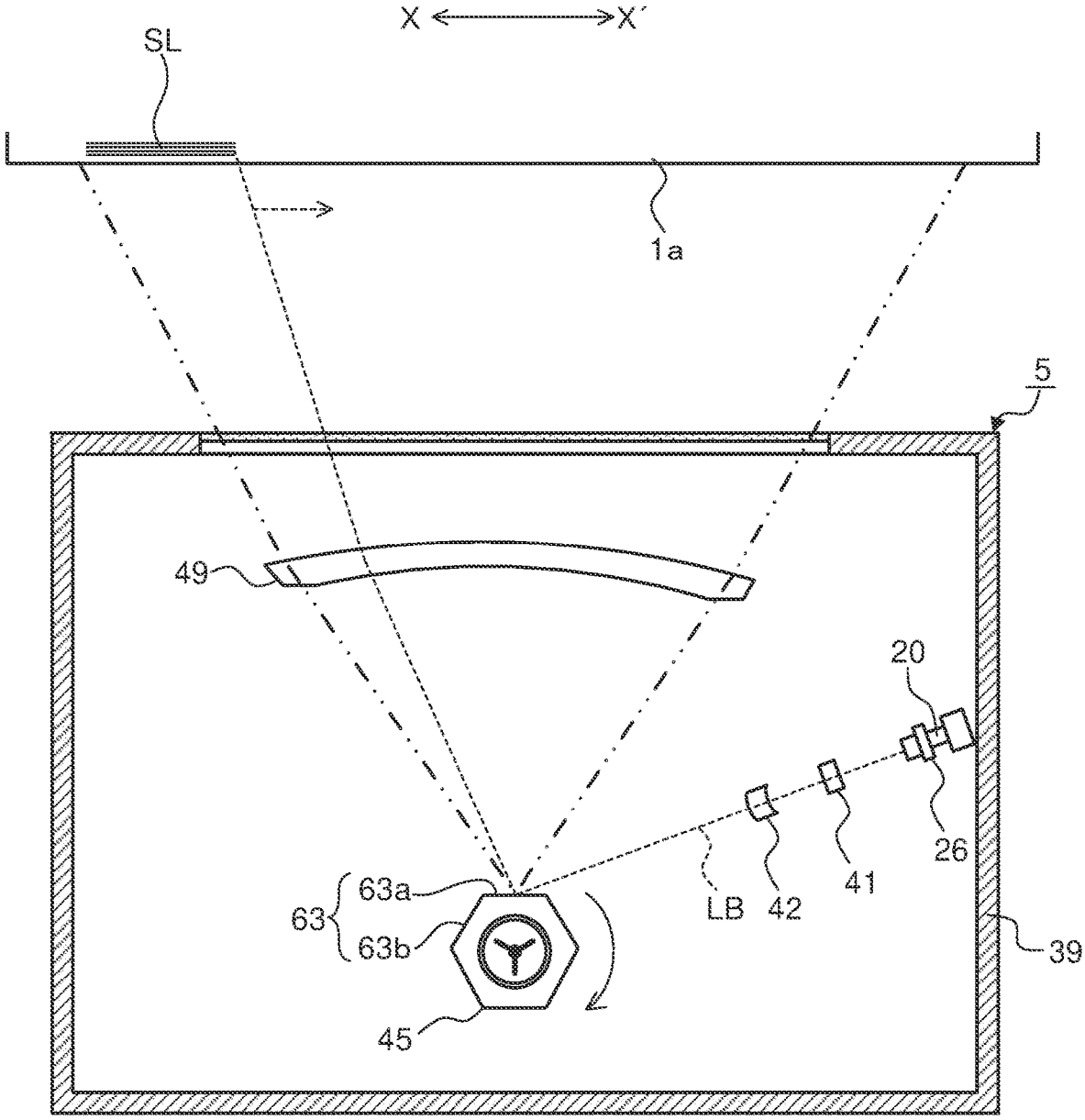
FIG. 2 is a plan cross-sectional view schematically showing the configuration of a light scanning device.
Figure 3:
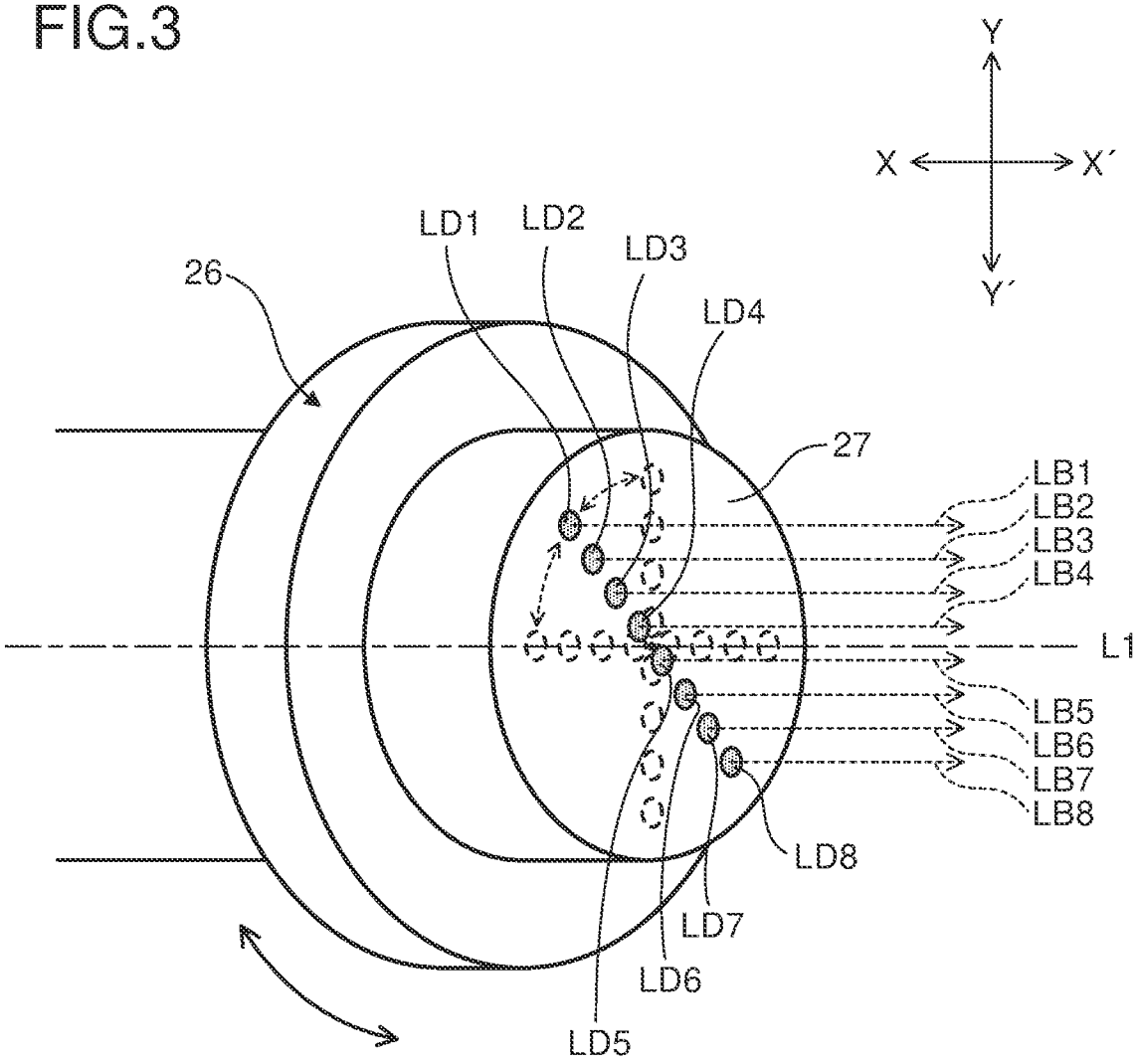
FIG. 3 is a perspective view showing a light source unit.

The light scanning device 5 in the first embodiment of the present disclosure will then be described in detail with reference to FIGS. 2 and 3. FIG. 2 is a plan cross-sectional view schematically showing the configuration of the light scanning device 5. FIG. 3 is a perspective view showing a light source unit 26. Although the light scanning device 5 scans light over the photoconductive drums 1*a* to 1*d*, a description will be given here of only light scanning over the photoconductive drum 1*a* with the omission of a description for the other photoconductive drums.

As shown in FIGS. 2 and 3, the light scanning device 5 includes an enclosure 39, the light source unit 26 housed in the enclosure 39, a collimator lens 41, a cylindrical lens 42, a polygon mirror 45 and a scanning lens 49.

The light source unit 26 (light source) includes a tip surface 27, laser diodes LD1 to LD8 (light emitters) and a beam generating portion 20. As shown in FIG. 3, the tip surface 27 in the longitudinal direction of the light source unit 26 is a circular flat surface. The light source unit 26 is rotated in a circumferential direction while an axis line (central axis LI) of a normal to the tip surface 27 which passes through the center of the tip surface 27 is set to a rotation axis, and thus intervals between the laser diodes LD1 to LD8 in a subscanning direction are adjusted and fixed.

The laser diodes LD1 to LD8 are arranged linearly along the radial direction of the light source unit 26 at equal intervals. The beam generating portion 20 generates, based on image information transmitted from the control portion 90 to be described later, light beams LB (hereinafter also individually referred to as light beams LB1 to LB8) emitted separately from the laser diodes LD1 to LD8.

When the rotation of the light source unit 26 is adjusted so that the intervals between the laser diodes LD1 to LD8 in the subscanning direction are adjusted, intervals between the laser diodes LD1 to LD8 in a main scanning direction are changed. In a state where the laser diodes LD1 to LD8 are aligned linearly parallel to the subscanning direction (up/down direction shown in FIG. 3), the intervals between the laser diodes LD1 to LD8 in the main scanning direction are minimized. By contrast, in a state where the laser diodes LD1 to LD8 are aligned linearly parallel to the main scanning direction (left/right direction shown in FIG. 3), the intervals between the laser diodes LD1 to LD8 in the main scanning direction are maximized (see, for both the states, portions indicated by broken lines in FIG. 3).

The collimator lens 41 changes the light beams LB emitted from the light source unit 26 into a substantially parallel light flux (parallel light flux). The cylindrical lens 42 has a predetermined refractive power only in the subscanning direction of the light beams LB. The light source unit 26, the collimator lens 41 and the cylindrical lens 42 are arranged linearly.

The polygon mirror 45 is a regular polygonal prism (here, a regular hexagonal prism) in which a deflection surface 63 is formed in each side surface. The deflection surfaces 63 are mirror surfaces, and can reflect the light beams LB emitted from the light source unit 26 to deflect them. The polygon mirror 45 is supported to be able to rotate about a central axis (not shown) extending along the up/down direction (direction of the plane of FIG. 2). The polygon mirror 45 is connected to a polygon motor (not shown) and is rotated by the rotational drive force of the polygon motor.

The scanning lens 49 is a lens which has f) characteristics. The scanning lens 49 is arranged between the photoconductive drum 1*a* and the polygon mirror 45. The light beams LB emitted from the light source unit 26 enter the collimator lens 41 and the cylindrical lens 42 in this order so as to form, as a diagram, an image on the deflection surface 63. The light beams LB which form the image on the deflection surface 63 are reflected and are passed through the scanning lens 49 to form, on the photoconductive drum 1*a*, an image having a spot diameter of a predetermined size.

The polygon mirror 45 is rotated by the polygon motor 46 at a constant speed in a clockwise direction shown in the figure. Hence, the light beams LB are scanned at a constant speed on the scanned surface of the photoconductive drum 1*a* in the main scanning direction (direction indicated by an arrow X' in the figure). In this way, on the scanned surface of the photoconductive drum 1*a*, a scanning line SL extending linearly in the main scanning direction is formed. One scanning line SL is drawn for one deflection surface 63. By the rotation of the polygon mirror 45, images are sequentially formed with the light beams LB on the adjacent deflection surfaces 63. Since the photoconductive drum 1*a* is rotated, a plurality of scanning lines SL are formed in the subscanning direction to form electrostatic latent images.

Figure 4:
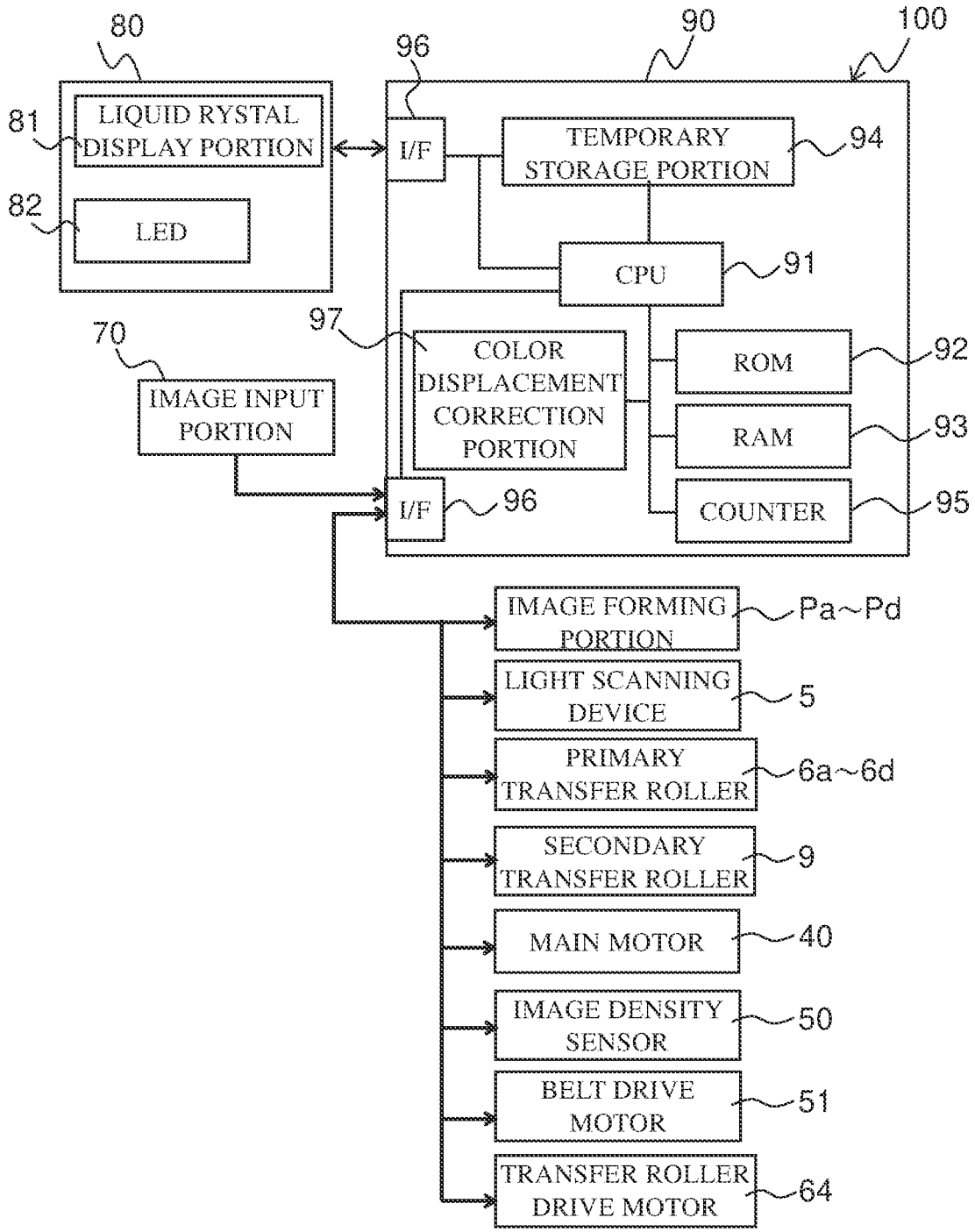
FIG. 4 is a block diagram showing an example of a control path in the image forming apparatus of the first embodiment.

FIG. 4 is a block diagram showing an example of a control path in the image forming apparatus 100 of the present embodiment. Since various types of control are performed on the portions of the apparatus in the use of the image forming apparatus 100, the control path of the entire image forming apparatus 100 is complicated. Hence, here, a part of the control path which is necessary for implementing the present disclosure will be mainly described.

The control portion 90 includes a CPU (Central Processing Unit) 91, a ROM (Read Only Memory) 92 (storage portion), a RAM (Random Access Memory) 93, a temporary storage portion 94, a counter 95, an I/F (interface) 96 and a color displacement correction portion 97. The CPU 91 plays a role as a central processing unit. The ROM 92 is a read-only storage portion. The RAM 93 is a readable/writable storage portion. The temporary storage portion 94 temporarily stores the image data and the like. The counter 95 accumulates and counts the number of sheets printed. The I/F 96 transmits control signals to devices in the image forming apparatus 100 and receives input signals from an operation portion 80. A plurality of I/Fs 96 (here, two) are provided. The color displacement correction portion 97 corrects a displacement in the electrostatic latent images drawn on the photoconductive drum 1*a* to perform a color displacement amendment for an output image. The control portion 90 can be arranged in any location in the main body of the image forming apparatus 100.

In the ROM 92, data and the like, such as control programs for the image forming apparatus 100 and necessary values for control, which are not changed during the use of the image forming apparatus 100 are stored. In the ROM 92, evaluation charts CT (image data used for calibration) for performing the color displacement correction (calibration) are stored. In the RAM 93, necessary data generated during control of the image forming apparatus 10, data temporarily required for controlling the image forming apparatus 100 and the like are stored. In the RAM 93 (or the ROM 92), a density correction table used for the color displacement correction and the like are also stored.

The control portion 90 transmits the control signals to the portions and the devices in the image forming apparatus 100 from the CPU 91 through the I/Fs 96. Signals indicating states and the input signals are transmitted from the portions and the devices to the CPU 91 through the I/Fs 96. Examples of the portions and the devices controlled by the control portion 90 include the image forming portions Pa to Pd, the light scanning device 5, the primary transfer rollers 6*a* to 6*d*, the secondary transfer roller 9, the main motor 40, the image density sensor 50, the belt drive motor 51, a transfer roller drive motor 64, an image input portion 70, a voltage control circuit 71, the operation portion 80 and the like.

The image density sensor 50 emits measurement light from a light-emitting element to the evaluation chart CT formed on the intermediate transfer belt 8, and measures the intensity and the like of the measurement light (including light reflected off the toners and light reflected off the surface of the belt) which is reflected to enter light-receiving elements.

The light reflected off the toners and the surface of the belt includes specular reflected light and diffused reflected light. The specular reflected light and the diffused reflected light are separated with a polarization separation prism to enter the separate light-receiving elements. The light-receiving elements photoelectrically convert the specular reflected light and the diffused reflected light which have been received, and output output signals to the control portion 90 (the color displacement correction portion 97).

The color displacement correction portion 97 determines the image density (the amount of toner) and an image position in the evaluation chart CT from the results of the detection by the image density sensor 50 (characteristic changes in the output signals of the specular reflected light and the diffused reflected light). The color displacement correction portion 97 compares the results of the determination with a reference density and a reference position previously stored in the ROM 92 to adjust the characteristic value of a development voltage, the rotation angle of the light source unit 26, timing at which the laser diodes LD1 to LD8 emit light and the like, and thereby corrects the positions of dots DT1 to DT8 (see FIG. 5) drawn by the light beams LB1 to LB8, with the result that the density correction and the color displacement correction for the colors are performed. Hereinafter, the dots which are respectively drawn by the light beams LB1 to LB8 are referred to as the "dots DT1 to DT8".

The color displacement correction portion 97 determines, from the results of the determination of the image density in the evaluation chart CT, whether or not the dots DT1 to DT8 are displaced (whether or not a dot displacement occurs). When the dot displacement occurs, a dot displacement correction value is calculated based on the results of the determination of the image density in the evaluation chart CT. The control portion 90 adjusts, based on the dot displacement correction value, the timing at which the laser diodes LD1 to LD8 emit light (the amount of displacement of timing at which the light beams LB1 to LB8 are emitted). In this way, the positions of the dots DT1 to DT8 in the main scanning direction are adjusted, and thus it is possible to correct the dot displacement.

The image input portion 70 is a reception portion which receives the image data transmitted from the high-level device such as a personal computer to the image forming apparatus 100. Image signals input by the image input portion 70 are converted into digital signals, and thereafter, the digital signals are sent to the temporary storage portion 94.

In the operation portion 80, a liquid crystal display portion 81 and LEDs 82 which indicate various types of states are provided. A user operates a stop/clear button in the operation portion 80 to stop the image formation, and operates a reset button to bring various types of settings in the image forming apparatus 100 into a default state. The liquid crystal display portion 81 indicates the state of the image forming apparatus 100, and displays the status of the image formation and the number of sheets printed. The various types of settings in the image forming apparatus 100 are made from a printer driver.

Figure 5:
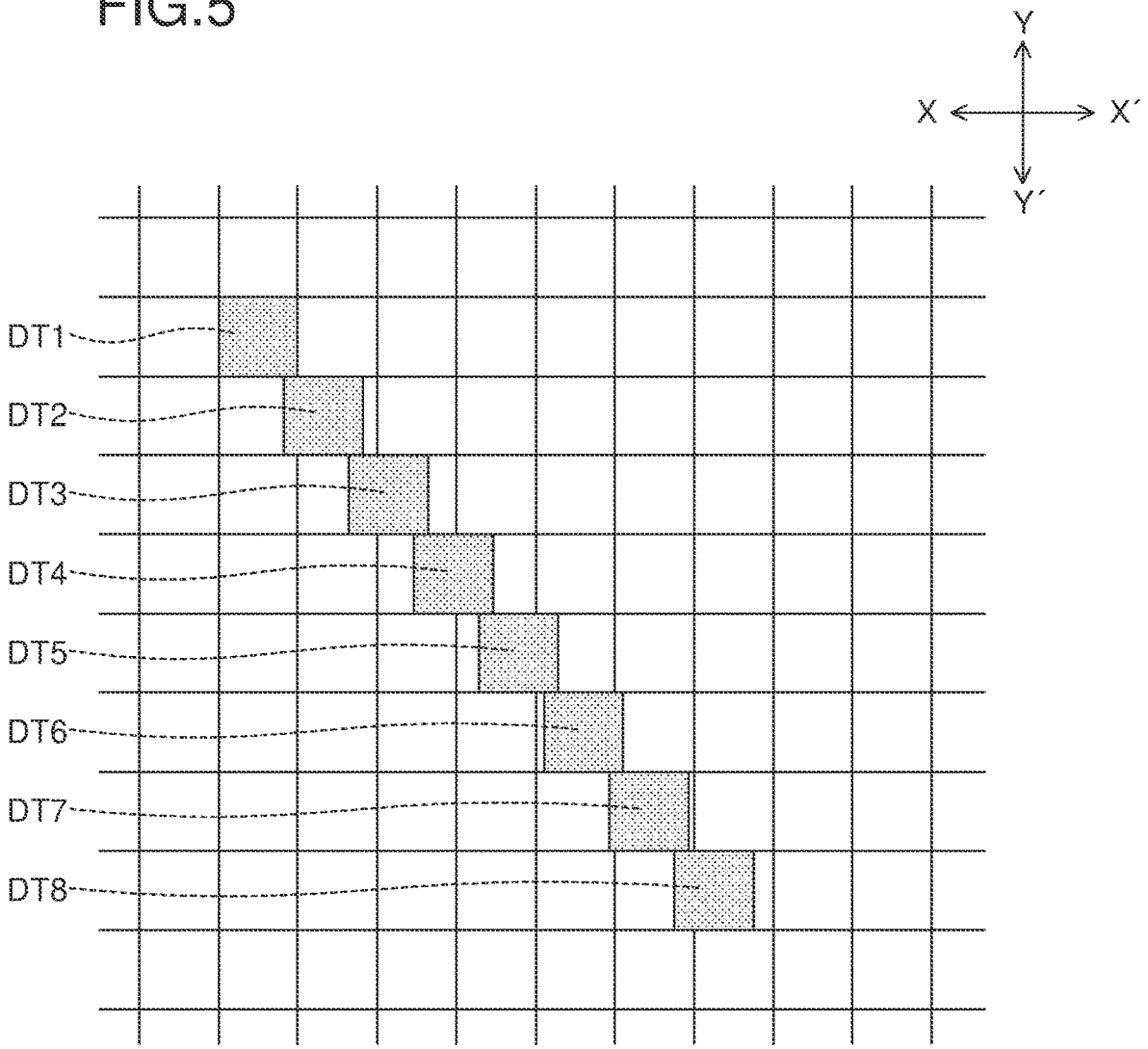
FIG. 5 is a diagram showing the start of writing of dots formed as an image on a photoconductive drum when all laser diodes are simultaneously lit and all light beams are emitted.
Figure 6:
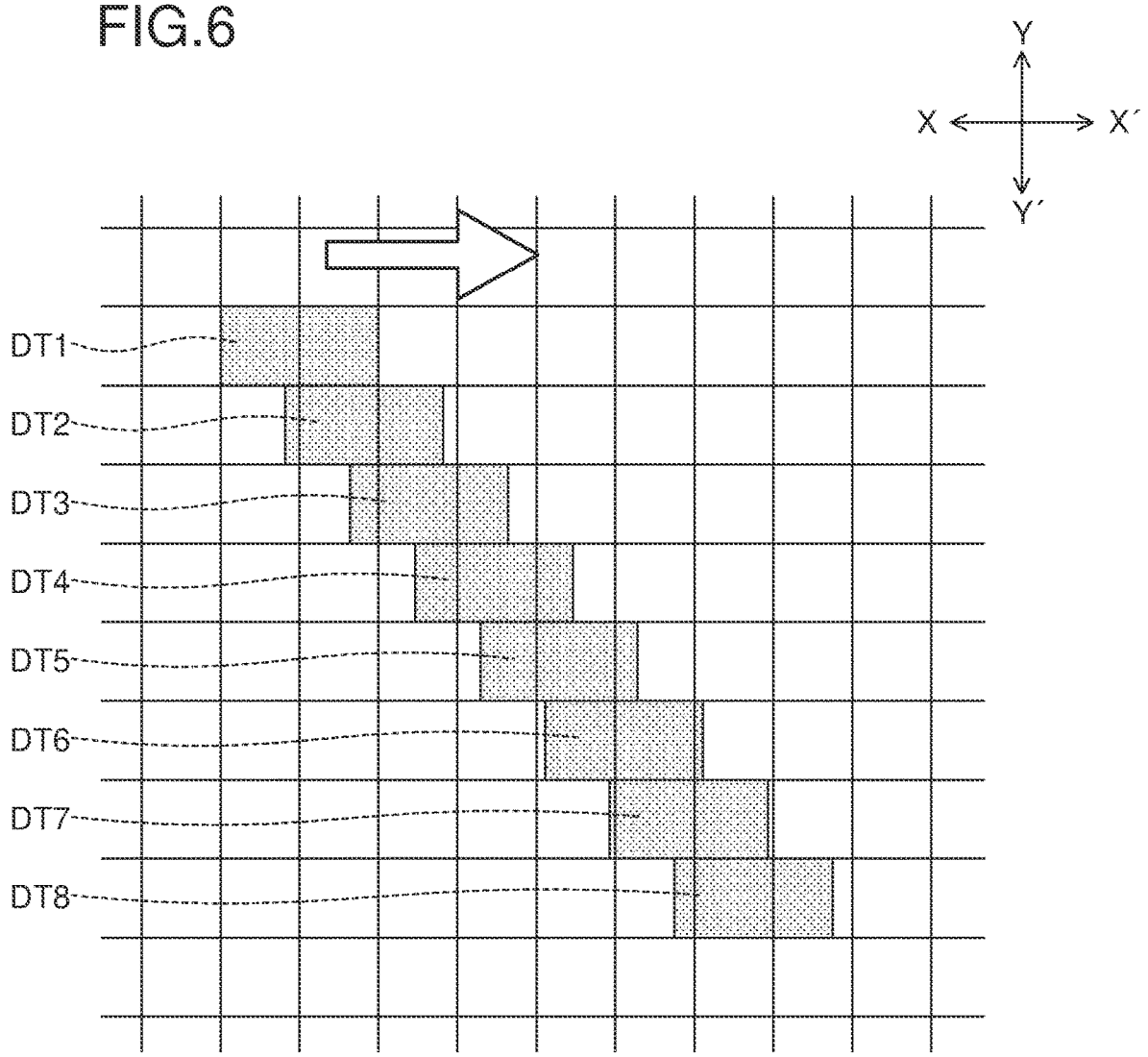
FIG. 6 is a diagram showing a state where the light beams are scanned in a main scanning direction from the state of FIG. 5.
Figure 7:
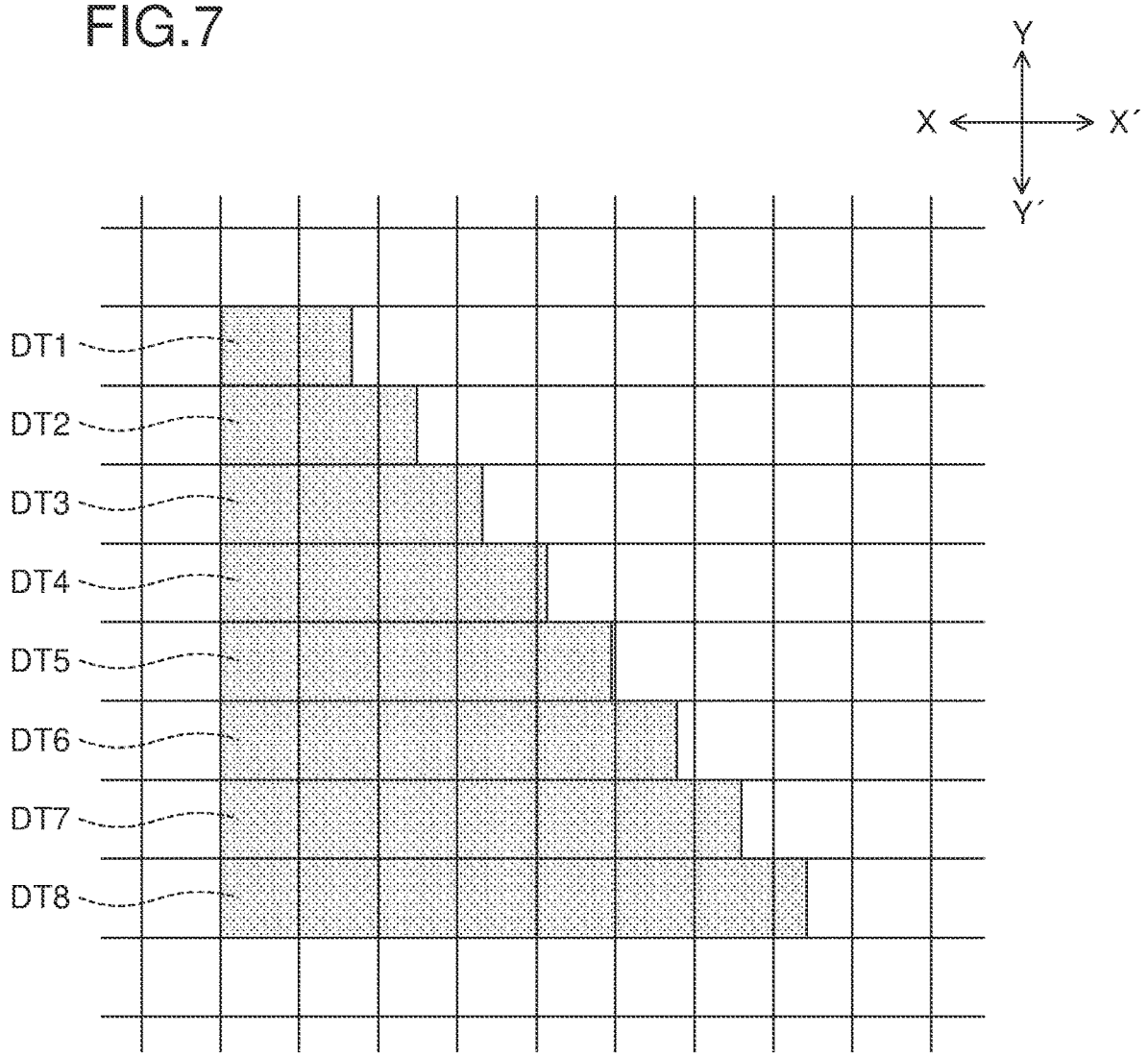
FIG. 7 is a diagram showing an electrostatic latent image in a state where timing at which the laser diodes emit light is adjusted such that the writing start positions of the dots are the same position in the main scanning direction.

FIG. 5 is a diagram showing the start of writing of the dots DT1 to DT8 formed as an image on the photoconductive drum 1*a* when all the laser diodes LD1 to LD8 are simultaneously lit to emit all the light beams LB1 to LB8. FIG. 6 is a diagram showing a state where the light beams LB1 to LB8 are scanned in the main scanning direction from the state of FIG. 5. FIG. 7 is a diagram showing an electrostatic latent image in a state where the timing at which the laser diodes LD1 to LD8 emit light is adjusted such that the writing start positions of the dots DT1 to DT8 are the same position in the main scanning direction.

The light beams LB1 to LB8 draw the dots DT1 to DT8 on the scanned surface of the photoconductive drum 1*a* (see FIG. 5). When all the laser diodes LD1 to LD8 are made to emit light with the same timing from the light source unit 26 at a predetermined rotation angle so as to emit the light beams LB1 to LB8, as shown in FIG. 5, a straight line (a row of the dots DT1 to DT8) which is inclined with respect to the subscanning direction is drawn on the scanned surface. When in this state, the light beams LB1 to LB8 are scanned on the scanned surface of the photoconductive drum 1*a* in the main scanning direction by the rotation of the polygon mirror 45, as shown in FIG. 6, an electrostatic latent image in a state where writing start portions are inclined with respect to the subscanning direction is drawn.

In order to align the writing start positions of the electrostatic latent image in the main scanning direction, the color displacement correction portion 97 controls the timing at which the laser diodes LD1 to LD8 emit light. For example, in order to draw the electrostatic latent image in which the writing start positions of the light beams LB1 to LB8 are the same position in the main scanning direction, the timing at which the laser diodes LD1 to LD8 emit light is set such that the writing is started sequentially from the dot most displaced to the downstream side in the main scanning direction among the dots DT1 to DT8, that is, that the laser diodes LD8, LD7, LD6, LD5, LD4, LD3, LD2 and LD1 are made to emit light in this order, with the result that the light beams LB1 to LB8 are emitted.

By contrast, in order to align writing end portions in the main scanning direction, timing at which the laser diodes LD1 to LD8 are turned off is set to the same order described above (here, in the order of LD8, LD7, LD6, LD5, LD4, LD3, LD2 and LD1) (not shown). The color displacement correction portion 97 calculates, from the image density in the evaluation chart CT detected by the image density sensor 50, timing at which the laser diodes LD1 to LD8 are turned on and off, and outputs output signals to the light source unit 26.

Figure 8:
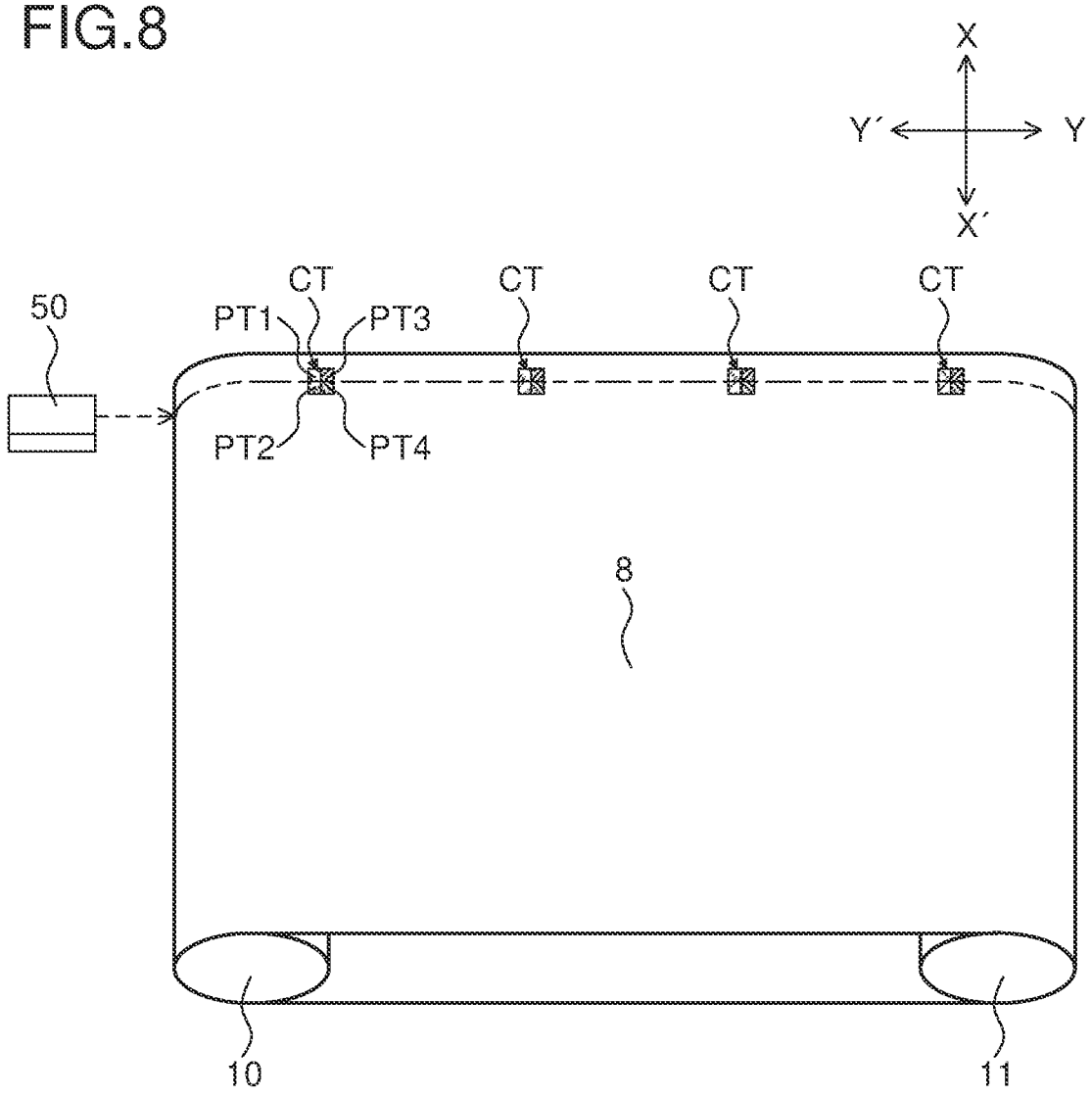
FIG. 8 is a perspective view showing an intermediate transfer belt on which evaluation charts are formed.

FIG. 8 is a diagram showing the intermediate transfer belt 8 on which the evaluation charts CT are formed. In drawings including FIG. 8 where the evaluation chart CT is enlarged, a left/right direction in the plane of the figure (direction indicated by arrows X-X' shown in the figure) is assumed to be the main scanning direction, and an up/down direction in the plane of the figure (direction indicated by arrows Y-Y' shown in the figure) is assumed to be the subscanning direction. As shown in FIG. 8, the evaluation charts CT visualized by the developing devices 3*a* to 3*d* are formed on the intermediate transfer belt 8. The evaluation charts CT are respectively drawn for magenta, cyan, yellow and black.

A plurality of evaluation charts CT are linearly drawn in the circumferential direction of the intermediate transfer belt 8 (the subscanning direction (the direction indicated by arrows Y-Y' in FIG. 8)) to be spaced at predetermined intervals. The evaluation charts CT are arranged in positions which overlap the image density sensor 50 in the direction of the width of the intermediate transfer belt 8 (the main scanning direction (the direction indicated by arrows X-X' in FIG. 8)). The intermediate transfer belt 8 is rotated, and thus the image density sensor 50 can measure the evaluation charts CT a plurality of times, calculates the displacement of the dots DT1 to DT8 (dot displacement) from the average value of the results of the measurements performed a plurality of times and thereby reduces unevenness in the detection.

The evaluation chart CT includes a first evaluation pattern PT1, a second evaluation pattern PT2, a third evaluation pattern PT3 and a fourth evaluation pattern PT4 which are drawn in a rectangular shape. The first evaluation pattern PT1 and the second evaluation pattern PT2 are arranged adjacent in the main scanning direction. The third evaluation pattern PT3 and the fourth evaluation pattern PT4 are also arranged adjacent in the main scanning direction. The third evaluation pattern PT3 is adjacent to the downstream side of the first evaluation pattern PT1 in the subscanning direction. The fourth evaluation pattern PT4 is adjacent to the downstream side of the second evaluation pattern PT2 in the subscanning direction.

The first to fourth evaluation patterns PT1 to PT4 are formed by arranging a plurality of first to fourth evaluation patches PC1 to PC4 having different shapes in the main scanning direction and the subscanning direction. The first evaluation pattern PT1 will be described in detail below, and for the other evaluation patterns PT3 and PT4, only parts different from the first evaluation pattern PT1 will be described.

Figure 9:
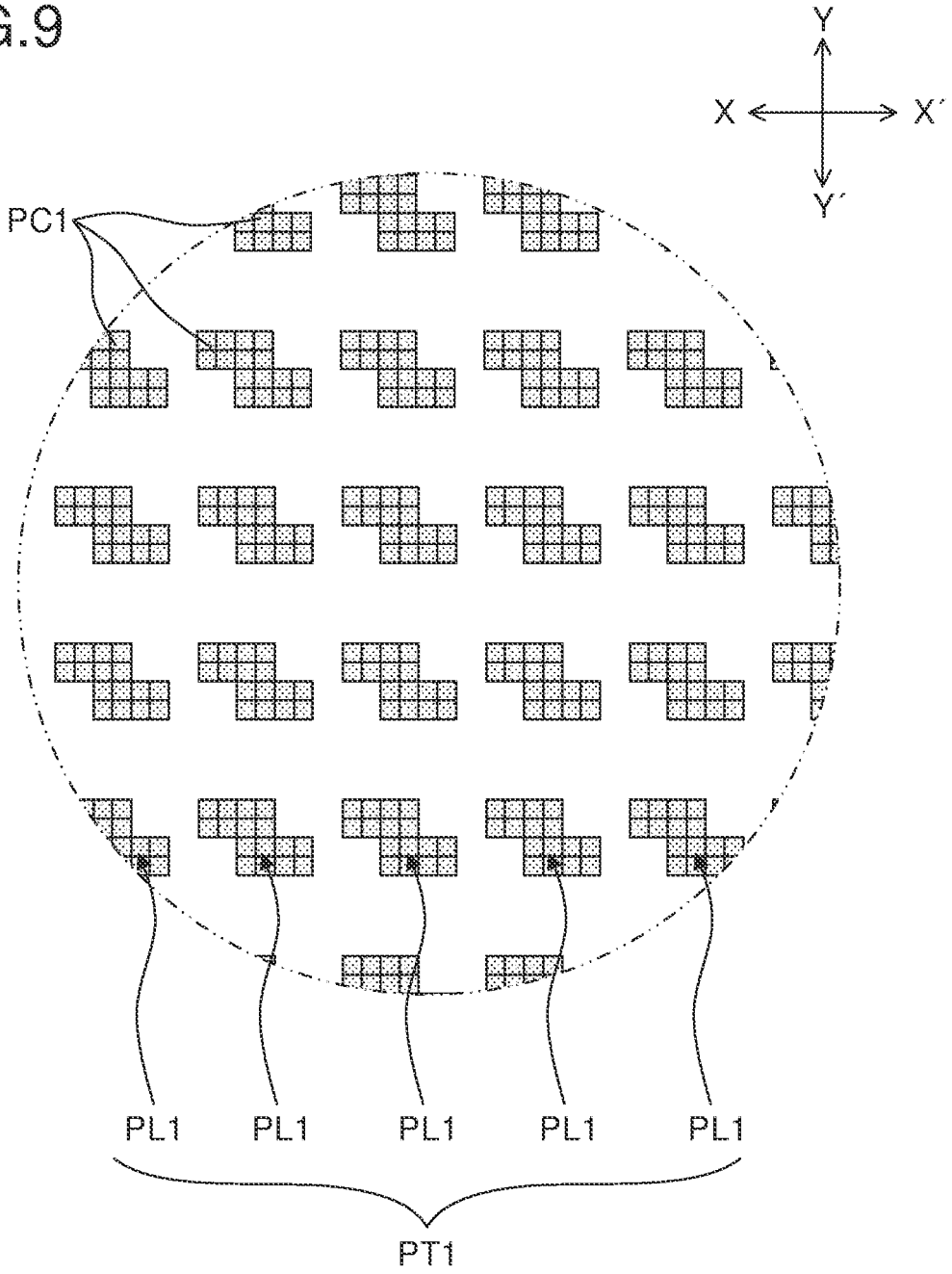
FIG. 9 is an enlarged plan view of a first evaluation pattern in the evaluation chart.

FIG. 9 is an enlarged plan view of a part of the first evaluation pattern PT1 shown in FIG. 8. As shown in FIG. 9, the first evaluation pattern PT1 includes a plurality of first evaluation patches PC1. The first evaluation patches PC1 are arranged to be spaced at predetermined intervals in the main scanning direction (direction indicated by arrows X-X' in the figure) and in the subscanning direction (direction indicated by arrows Y-Y' in the figure). A plurality of first evaluation patches PC1 are arranged to be spaced at predetermined intervals in the subscanning direction so as to form a first patch row PL1. A plurality of first patch rows PL1 are arranged to be spaced at predetermined intervals in the main scanning direction so as to form the first evaluation pattern PT1.

Figure 10:
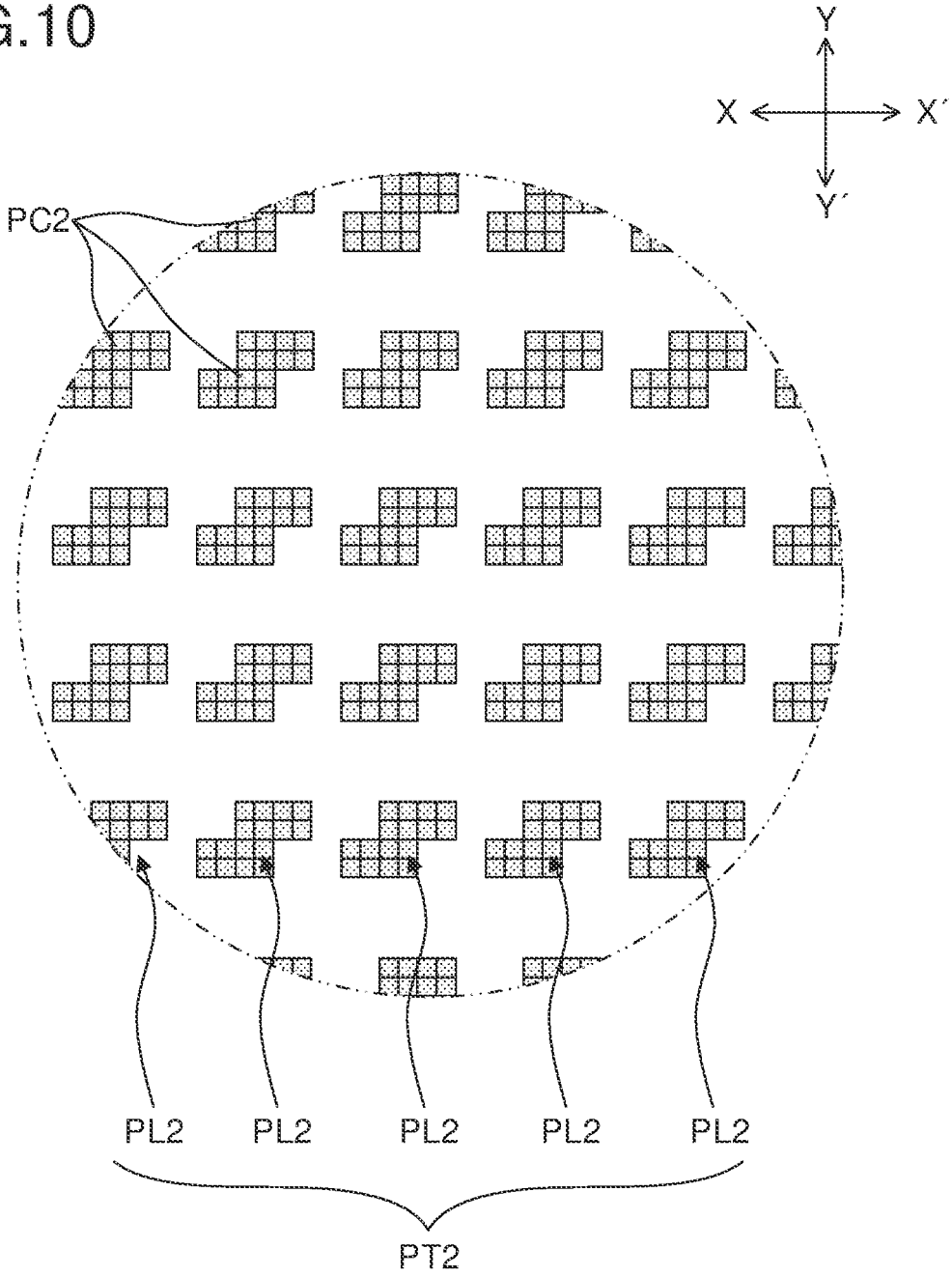
FIG. 10 is an enlarged plan view of a part of a second evaluation pattern shown in FIG. 8.

FIG. 10 is an enlarged plan view of a part of the second evaluation pattern PT2 shown in FIG. 8. As shown in FIG. 10, the second evaluation pattern PT2 includes a plurality of second evaluation patches PC2. The second evaluation patches PC2 are arranged to be spaced at predetermined intervals in the main scanning direction and in the subscanning direction. A plurality of second evaluation patches PC2 are arranged to be spaced at predetermined intervals in the subscanning direction so as to form a second patch row PL2. A plurality of second patch rows PL2 are arranged to be spaced at predetermined intervals in the main scanning direction so as to form the second evaluation pattern PT2.

Figure 11:
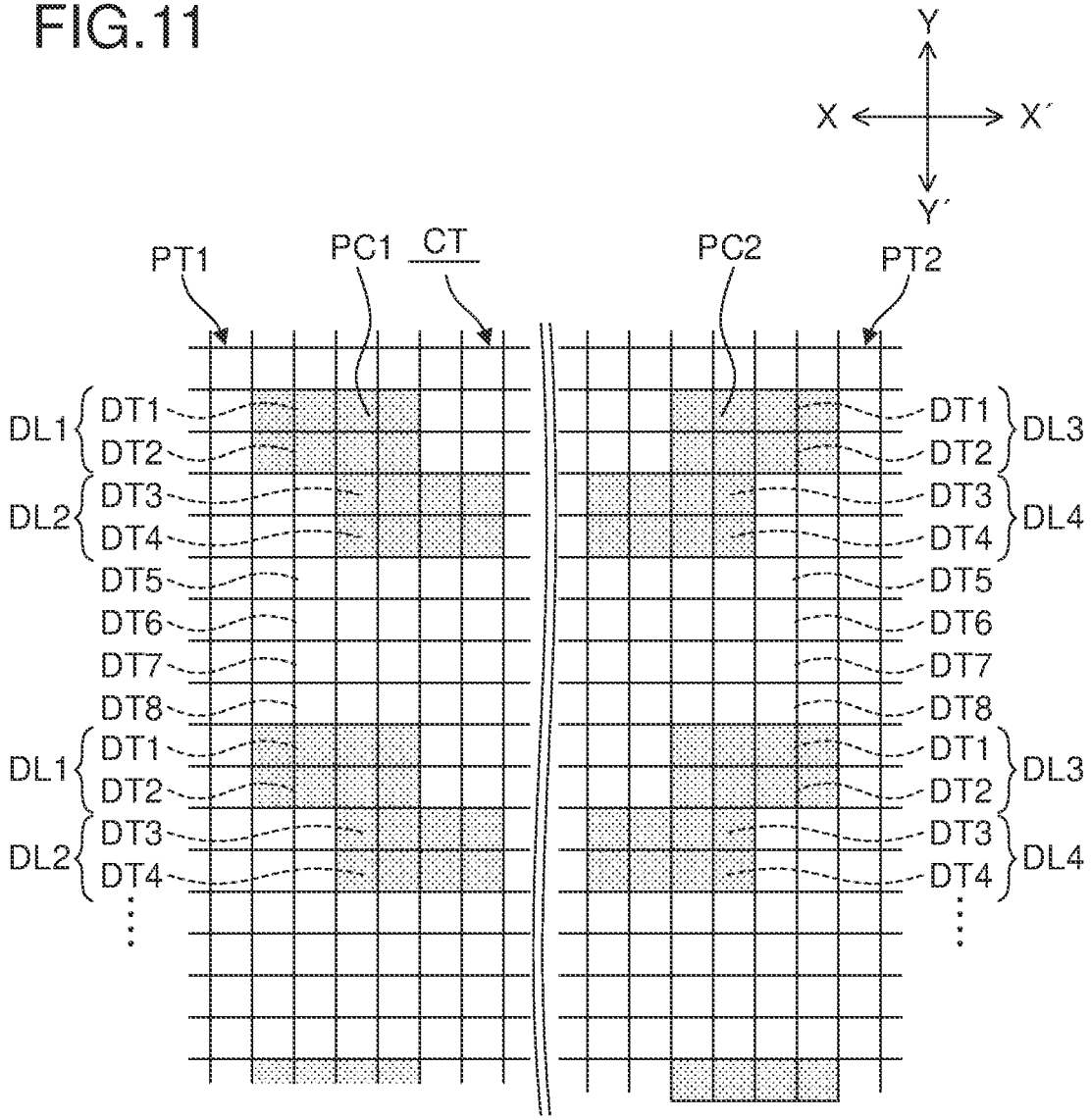
FIG. 11 is an enlarged plan view of the first evaluation pattern and the second evaluation pattern.

FIG. 11 is an enlarged plan view of the first evaluation pattern PT1 and the second evaluation pattern PT2. As shown in FIG. 11, the first evaluation patch PC1 is drawn with the light beams LB1 to LB4 emitted from the laser diodes LD1 to LD4 by selecting, dot by dot, the turning on and off thereof. The first evaluation patch PC1 includes a first dot row DL1 and a second dot row DL2. The first dot row DL1 and the second dot row DL2 are rows of dots DT1 and DT2 and dots DT3 and DT4 drawn linearly and continuously such that each of the first dot row DL1 and the second dot row DL2 has a length corresponding to two dots in the subscanning direction and a length corresponding to four dots in the main scanning direction.

The first dot row DL1 is drawn by the light beams LB1 and LB2 emitted from the laser diodes LD1 and LD2 (see FIG. 3). Specifically, the first dot row DL1 is formed with a plurality of dots DT1 and dots DT2 which are arranged linearly and continuously in the main scanning direction. In the dots DT1 and the dots DT2, the writing start positions in the main scanning direction are the same position.

The second dot row DL2 is drawn by the light beams LB3 and LB4 emitted from the laser diodes LD3 and LD4 (see FIG. 3). Specifically, the second dot row DL2 is formed with a plurality of dots DT3 and dots DT4 which are arranged linearly and continuously in the main scanning direction. In the dots DT3 and the dots DT4, the writing start positions in the main scanning direction are the same position.

The second dot row DL2 is continuously connected to the downstream side of the first dot row DL1 in the subscanning direction. The second dot row DL2 is displaced a predetermined number of dots (here, two dots) with respect to the first dot row DL1 to the downstream side in the main scanning direction.

As shown in FIG. 11, as with the first evaluation patch PC1, the second evaluation patch PC2 is drawn with the light beams LB1 to LB4 emitted from the laser diodes LD1 to LD4 by selecting, dot by dot, the turning on and off thereof.

The second evaluation patch PC2 includes a third dot row DL3 and a fourth dot row DL4. The third dot row DL3 and the fourth dot row DL4 are rows of dots drawn linearly and continuously such that each of the third dot row DL3 and the fourth dot row DL4 has a length corresponding to two dots in the subscanning direction and a length corresponding to four dots in the main scanning direction. The arrangement of the dots DT1 to DT4 in the second evaluation patch PC2 is symmetrical with the first evaluation patch PC1 in the main scanning direction.

Figure 12:
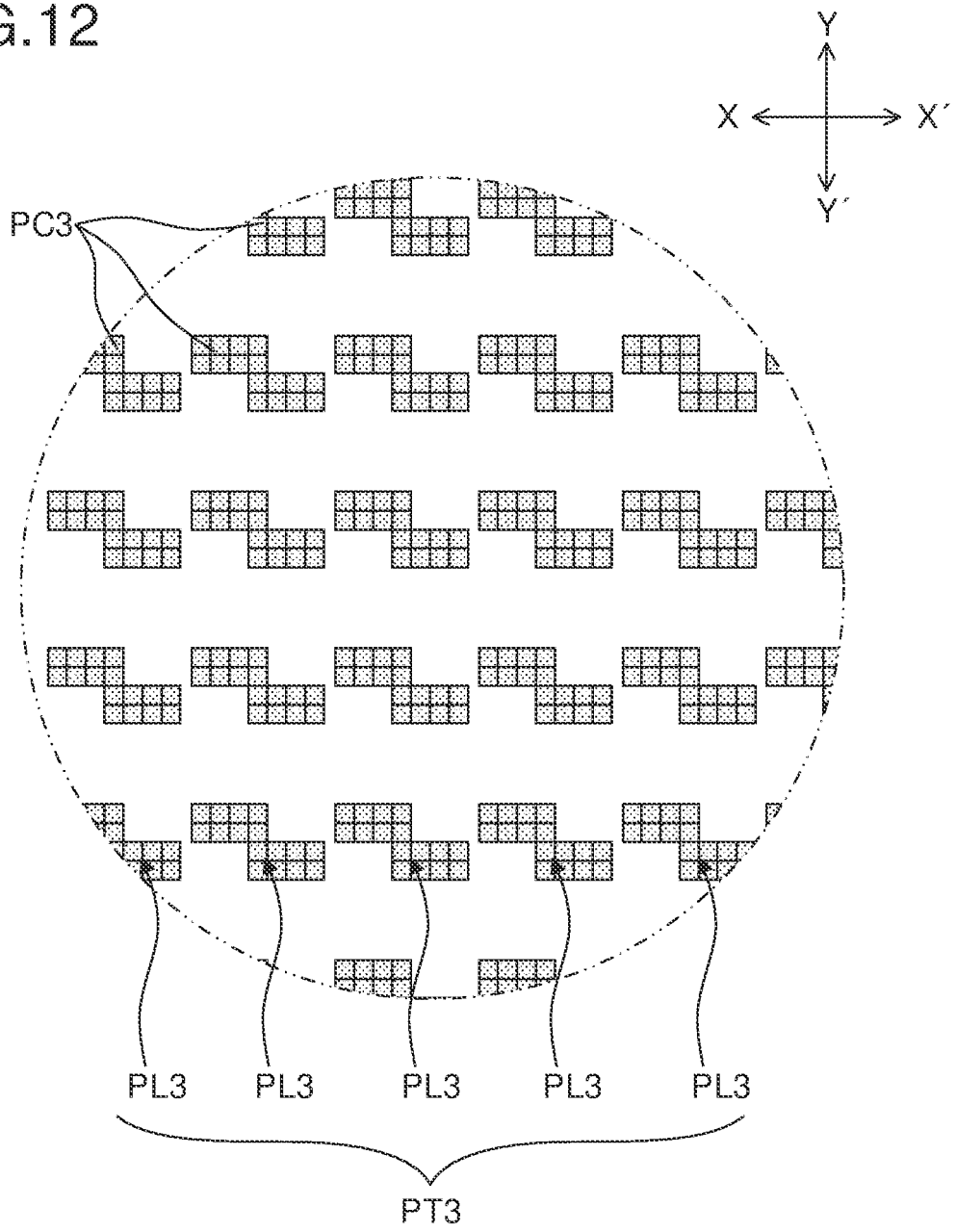
FIG. 12 is an enlarged plan view of a part of a third evaluation pattern shown in FIG. 8.

FIG. 12 is an enlarged view of a part of the third evaluation pattern PT3 shown in FIG. 8. As shown in FIG. 12, the third evaluation pattern PT3 includes a plurality of third evaluation patches PC3. A plurality of third evaluation patches PC3 are arranged to be spaced at predetermined intervals in the subscanning direction so as to form a third patch row PL3.

Figure 13:
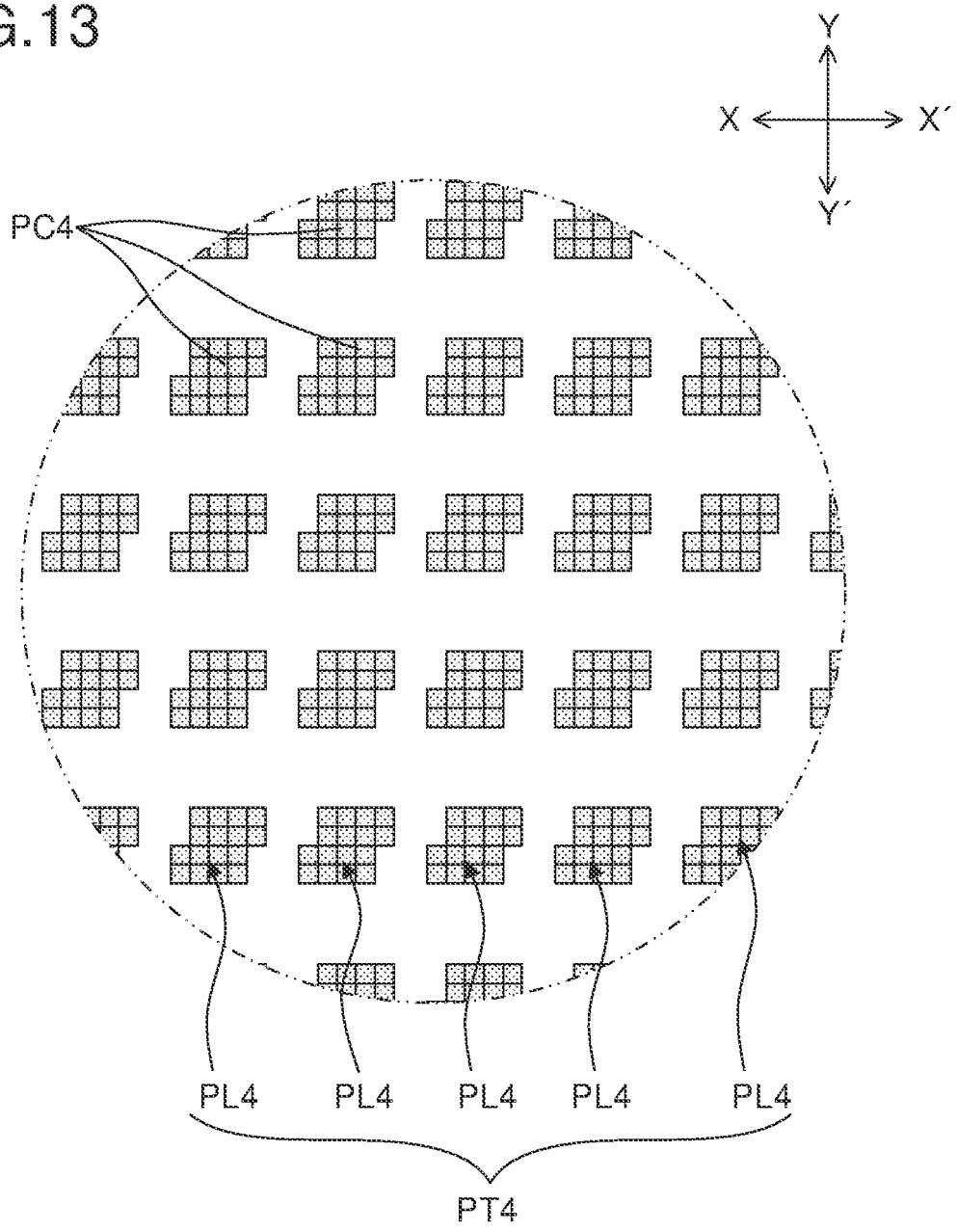
FIG. 13 is an enlarged plan view of a part of a fourth evaluation pattern shown in FIG. 8.

FIG. 13 is an enlarged view of the fourth evaluation pattern PT4 which is a part shown in FIG. 8. As shown in FIG. 13, the fourth evaluation pattern PT4 includes a plurality of fourth evaluation patches PC4. A plurality of fourth evaluation patches PC4 are arranged to be spaced at predetermined intervals in the subscanning direction so as to form a fourth patch row PL4.

Figure 14:
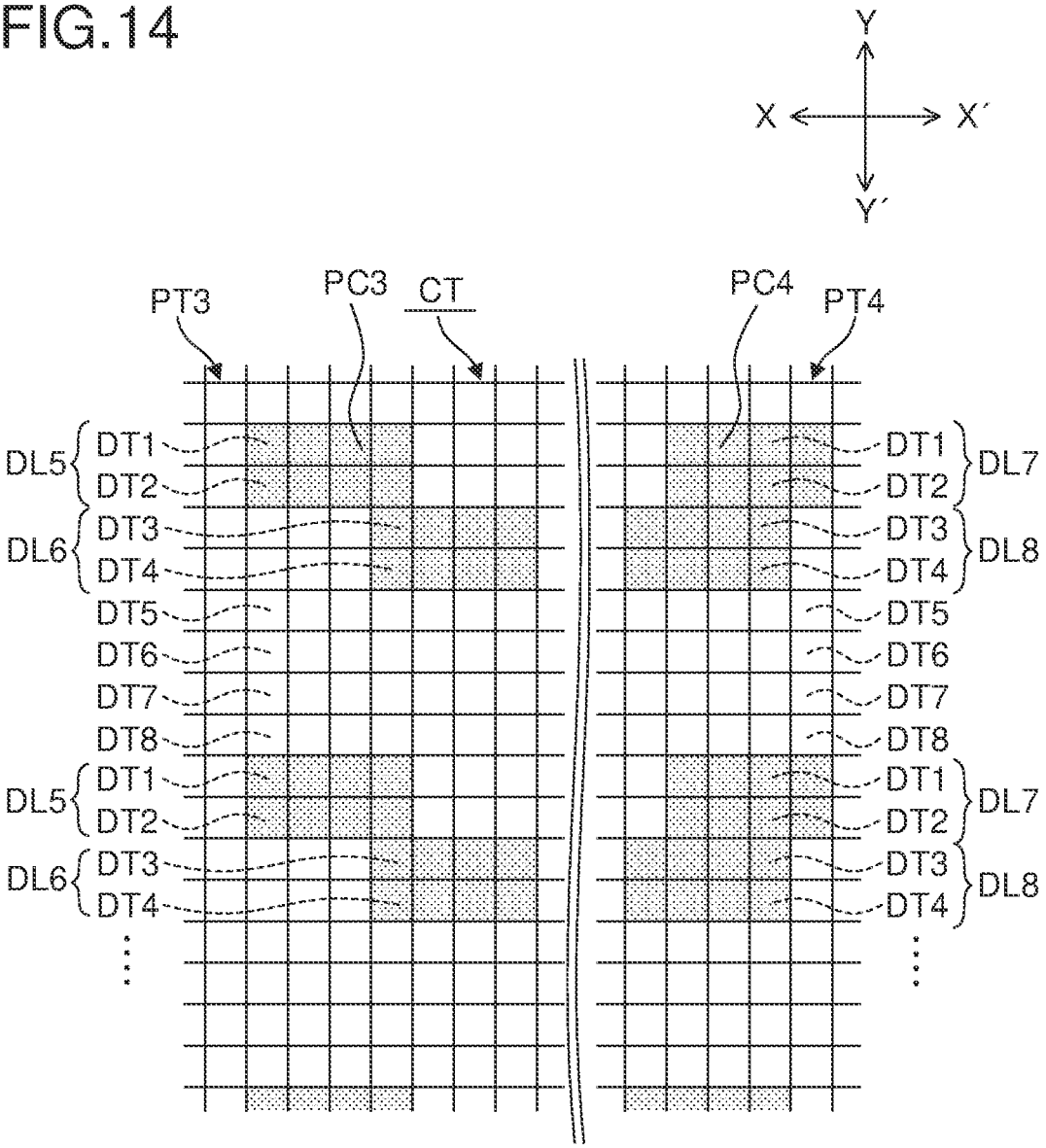
FIG. 14 is an enlarged plan view of the third evaluation pattern and the fourth evaluation pattern.

FIG. 14 is an enlarged plan view of the third evaluation pattern PT3 and the fourth evaluation pattern PT4. As shown in FIG. 14, the third evaluation patch PC3 includes a fifth dot row DL5 and a sixth dot row DL6. The fifth dot row DL5 and the sixth dot row DL6 are rows of dots DT1 and DT2 and dots DT3 and DT4 drawn linearly and continuously such that each of the fifth dot row DL5 and the sixth dot row DL6 has a length corresponding to two dots in the subscanning direction and a length corresponding to four dots in the main scanning direction.

The sixth dot row DL6 is continuously connected to the downstream side of the fifth dot row DL5 in the subscanning direction. The sixth dot row DL6 is displaced a predetermined number of dots with respect to the fifth dot row DL5 to the downstream side in the main scanning direction. The amount of dot displacement of the sixth dot row DL6 with respect to the fifth dot row DL5 in the main scanning direction is higher than the amount of dot displacement (2 dots, see FIG. 11) of the first dot row DL1 with respect to the second dot row DL2 in the main scanning direction by one dot to the downstream side in the main scanning direction or is lower than the amount thereof by one dot. Here, an example where the amount of dot displacement of the sixth dot row DL6 is higher than the amount of dot displacement of the first dot row DL1 by one dot to the downstream side (where the sixth dot row DL6 is displaced with respect to the fifth dot row DL5 to the downstream side in the main scanning direction by three dots) will be described.

The fourth evaluation patch PC4 includes a seventh dot row DL7 and an eighth dot row DL8. The seventh dot row DL7 and the eighth dot row DL8 are rows of dots DT1 and DT2 and dots DT3 and DT4 drawn linearly and continuously such that each of the seventh dot row DL7 and the eighth dot row DL8 has a length corresponding to two dots in the subscanning direction and a length corresponding to four dots in the main scanning direction.

The eighth dot row DL8 is continuously connected to the downstream side of the seventh dot row DL7 in the subscanning direction. The eighth dot row DL8 is displaced a predetermined number of dots (first dot number) with respect to the seventh dot row DL7 to an upstream side in the main scanning direction. The amount of dot displacement of the eighth dot row DL8 with respect to the seventh dot row DL7 in the main scanning direction is lower than the amount of dot displacement (2 dots, see FIG. 12) of the fourth dot row DL4 with respect to the third dot row DL3 in the main scanning direction by one dot to the upstream side in the main scanning direction or is higher than the amount thereof by one dot. Here, an example where the amount of dot displacement of the eighth dot row DL8 is lower than the amount of dot displacement of the seventh dot row DL7 by one dot to the upstream side (where the eighth dot row DL8 is displaced with respect to the seventh dot row DL7 to the upstream side in the main scanning direction by one dot) will be described.

In the case of this example, the third evaluation patch PC3 and the fourth evaluation patch PC4 are asymmetric in the main scanning direction. The shape of the third evaluation patch PC3 and the fourth evaluation patch PC4 is the same as a shape obtained by displacing the second dot row DL2 and the fourth dot row DL4 in the first evaluation patch PC and the second evaluation patch PC2 to the downstream side in the main scanning direction by one dot.

In other words, the sixth dot row DL6 and the eighth dot row DL8 are previously displaced with respect to the second dot row DL2 and the fourth dot row DL4 to the downstream side in the main scanning direction by one dot and are arranged. In order to distinguish between a dot displacement which is previously produced and a dot displacement which unintentionally occurs due to jitter or the like, the dot displacement which is previously produced is hereinafter referred to as a "specified displacement". The dot displacement which occurs due to jitter or the like is referred to as a "displacement such as jitter".

Figure 15:
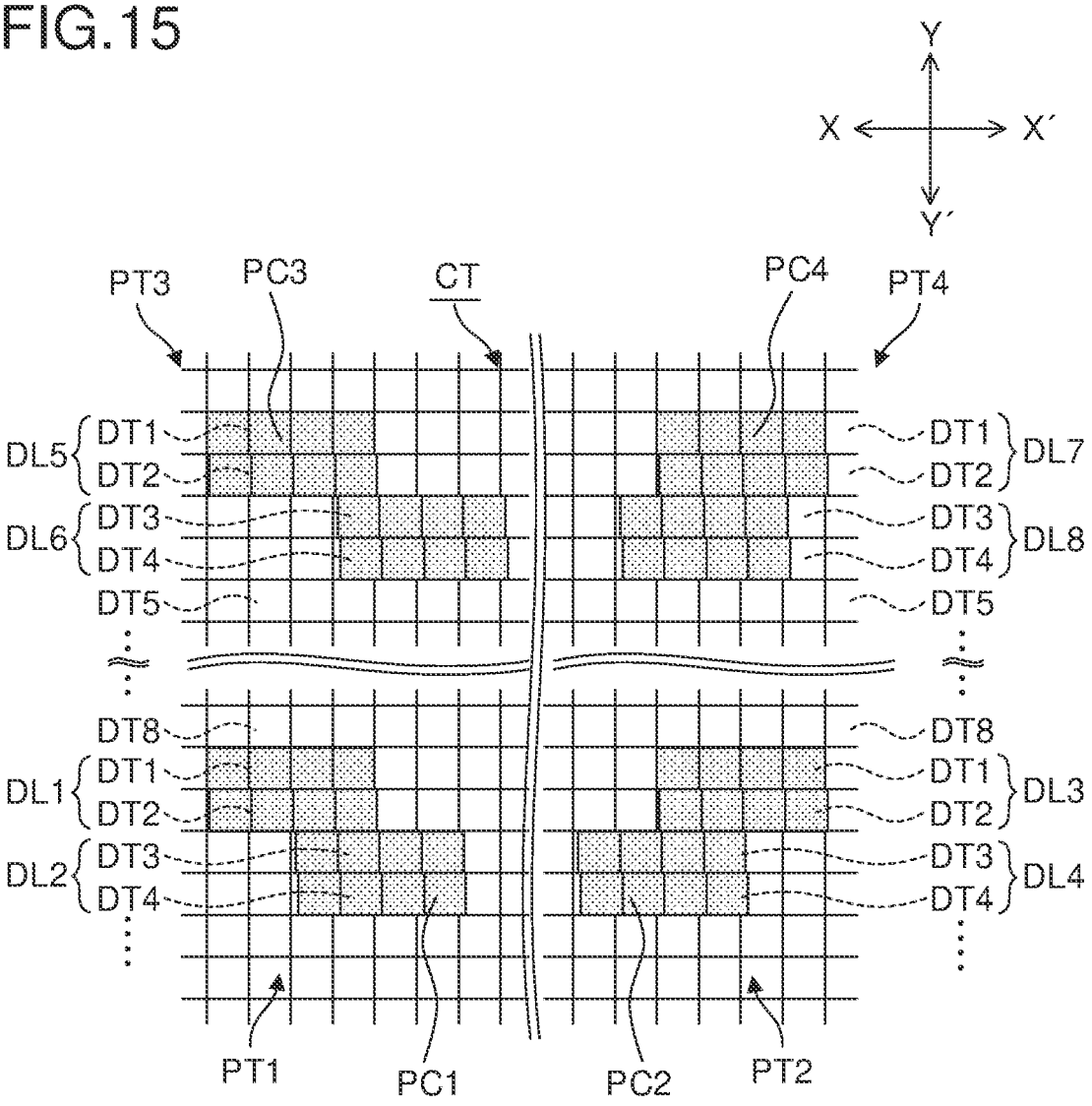
FIG. 15 is a plan view showing the evaluation chart in a first embodiment when a dot displacement occurs.

If a dot displacement occurs on the light beams LB2 to LB8 to the downstream side in the main scanning direction (the right side shown in the figure), as shown in FIG. 15, the dots DT2 to DT4 in the first to fourth evaluation patches PC1 to PC4 are displaced to the downstream side in the main scanning direction. Then, the first evaluation patch PC1 and the second evaluation patch PC2 are asymmetric in the main scanning direction, and thus a density difference occurs between an image density in the first evaluation patch PC1 (a ratio of the total area of the dots DT1 to DT4 drawn in a rectangular region to the rectangular region surrounded by a straight line overlapping both ends of the first dot row DL1 and the second dot row DL2 in the main scanning direction and a straight line overlapping both ends of the first evaluation patch PC1 in the subscanning direction) and an image density in the second evaluation patch PC2.

More specifically, in the first evaluation patch PC1, the dots DT4 in the second dot row DL2 located in the most downstream position in the main scanning direction are moved away from the dots DT1 in the first dot row DL1 located in the most upstream position in the main scanning direction, and thus both ends of the first dot row DL1 and the second dot row DL2 are deformed to be stretched in the main scanning direction. In this way, in the first evaluation patch PC1, the area of a white part which is not drawn with dots is increased. By contrast, in the second evaluation patch PC2, the dots DT4 in the fourth dot row DL4 located in the most upstream position in the main scanning direction are moved close to the dots DT2 in the third dot row DL3 located in the most downstream position in the main scanning direction, and thus both ends of the third dot row DL3 and the fourth dot row DL4 are deformed to be stretched in the main scanning direction. In this way, in the second evaluation patch PC2, the area of a white part is reduced. Hence, an image density in the first evaluation patch PC1 is decreased whereas an image density in the second evaluation patch PC2 is increased. Then, a density difference occurs between the image density in the first evaluation patch PC1 and the image density in the second evaluation patch PC2.

A density difference occurs between the image density in the first evaluation patch PC1 and the image density in the second evaluation patch PC2, and thus a density difference also occurs between an image density in the first evaluation pattern PT1 and an image density in the second evaluation pattern PT2. A difference in image density between the first evaluation pattern PT1 and the second evaluation pattern PT2 is assumed to be a first density difference.

On the other hand, in the third evaluation patch PC3 and the fourth evaluation patch PC4, as described above, the sixth dot row DL6 and the eighth dot row DL8 are previously displaced to the downstream side in the main scanning direction by one dot (specified displacement) and are arranged. Hence, before an unintentional dot displacement such as jitter occurs, a difference occurs between image densities in both of them (this difference in image density is assumed to be a second density difference). Then, when as shown in FIG. 15, a dot displacement occurs on the dots DT2 to DT4, the image density in the third evaluation patch PC3 is decreased as in the first evaluation patch PC1. By contrast, a development density in the fourth evaluation patch PC4 is increased as in the second evaluation patch PC2. In this way, the second density difference is changed.

The color displacement correction portion 97 calculates the first density difference and the second density difference from the image density in the evaluation chart CT detected with the image density sensor 50, and uses the first density difference and the second density difference to calculate the amount of displacement such as jitter.

A method for calculating the amount of dot displacement when a predetermined displacement such as jitter occurs will then be described with reference to FIG. 16 using an example where the first density difference is 0.0072 ($g/m^2$)

and the second density difference is −0.0148 (g/m$^2$). FIG. 16 is a graph showing a relationship between the magnitude of a specified displacement and a difference in development density. The horizontal axis represents the magnitude of the specified displacement (μm). The vertical axis represents the difference in development density between evaluation patterns adjacent in the main scanning direction.

Since as described above, the specified displacement is defined based on the second dot row DL2 and the fourth dot row DL4, the specified displacement does not occur on the second dot row DL2 and the fourth dot row DL4. Specifically, the specified displacement in the main scanning direction is zero. When this is plotted as a point P1 on the graph of FIG. 16, the coordinates (X, Y) of the point Pt are (0, 0.0072).

On the other hand, as described above, in the sixth dot row DL6 and the eighth dot row DL8, a specified displacement of one dot (+10.5 μm) to the downstream side in the main scanning direction is provided. When this is plotted as a point P2 on the graph of FIG. 16, the coordinates (X, Y) of the point P2 are (10.5, −0.0148).

Here, when the values of the displacement such as jitter and the specified displacement are equal to cancel each other, the evaluation patterns adjacent in the main scanning direction are symmetrical and the difference in development density thereof is removed, the difference in development density is zero. Hence, the value of the specified displacement when the difference in development density is zero is determined, and thus it is possible to calculate the magnitude of the displacement such as jitter. In the specific example described above, the X coordinate of a Point 3 serving as the x-intercept (difference in development density is zero) of a straight line connecting the Points P1 and P2 described above is 3.4188 μm. Since the specified displacement and the displacement such as jitter are in a relationship in which they cancel each other, that is, in a relationship in which the direction of the dot displacement is reversed (the positive and negative are reversed), the displacement such as jitter in this case is −3.4188 μm (3.4188 μm in the main scanning direction).

The amount of displacement in each of the dots DT2 to DT8 in the state where the dot displacement occurs is increased sequentially from the dots DT2 to the dots DT8 (as the dots are more distant from the dots DT1). In other words, the amount of dot displacement in the dots DT8 is higher than those in the other dots DT2 to DT7. This is because the amounts of dot displacement in the DT2 to DT7 are sequentially accumulated.

Here, shapes of the third evaluation patch PC3 and the fourth evaluation patch PC4 other than the shapes in the example described above can be adopted. For example, as shown in FIG. 17, for the third evaluation patch PC3, the shape in the example described above (the sixth dot row DL6 is displaced with respect to the fifth dot row DL5 to the downstream side in the main scanning direction by three dots) is adopted, and for the fourth evaluation patch PC, a shape can be adopted in which the amount of dot displacement of the eighth dot row DL8 with respect to the seventh dot row DL7 in the main scanning direction is higher than the amount of dot displacement of the fourth dot row DL4 with respect to the third dot row DL3 in the main scanning direction by one dot to the upstream side in the main scanning direction (where the eighth dot row DL8 is displaced with respect to the seventh dot row DL7 to the upstream side in the main scanning direction by three dots).

In this case, the third evaluation patch PC3 is symmetrical with the fourth evaluation patch PC4 in the main scanning direction. Hence, when no displacement occurs on the dots DT1 to DT8 in the main scanning direction, the second density difference does not occur, with the result that the displacement such as jitter cannot be calculated from the first density difference and the second density difference described above. Therefore, in this case, a difference in image density between the first evaluation pattern PT1 and the fourth evaluation pattern PT4 is assumed to be a second density difference, and instead of the second density difference, with the second' density difference and the first density difference, by the method described above, it is possible to calculate the displacement such as jitter. In this case, the difference (one dot in the main scanning direction) in the amount of displacement in the main scanning direction between the eighth dot row DL8 and the fourth dot row DL4 described above is synonymous with the magnitude of the specified displacement described above. The second' density difference may be assumed to be a difference in image density between the second evaluation pattern PT2 and the third evaluation pattern PT3.

Figure 17:
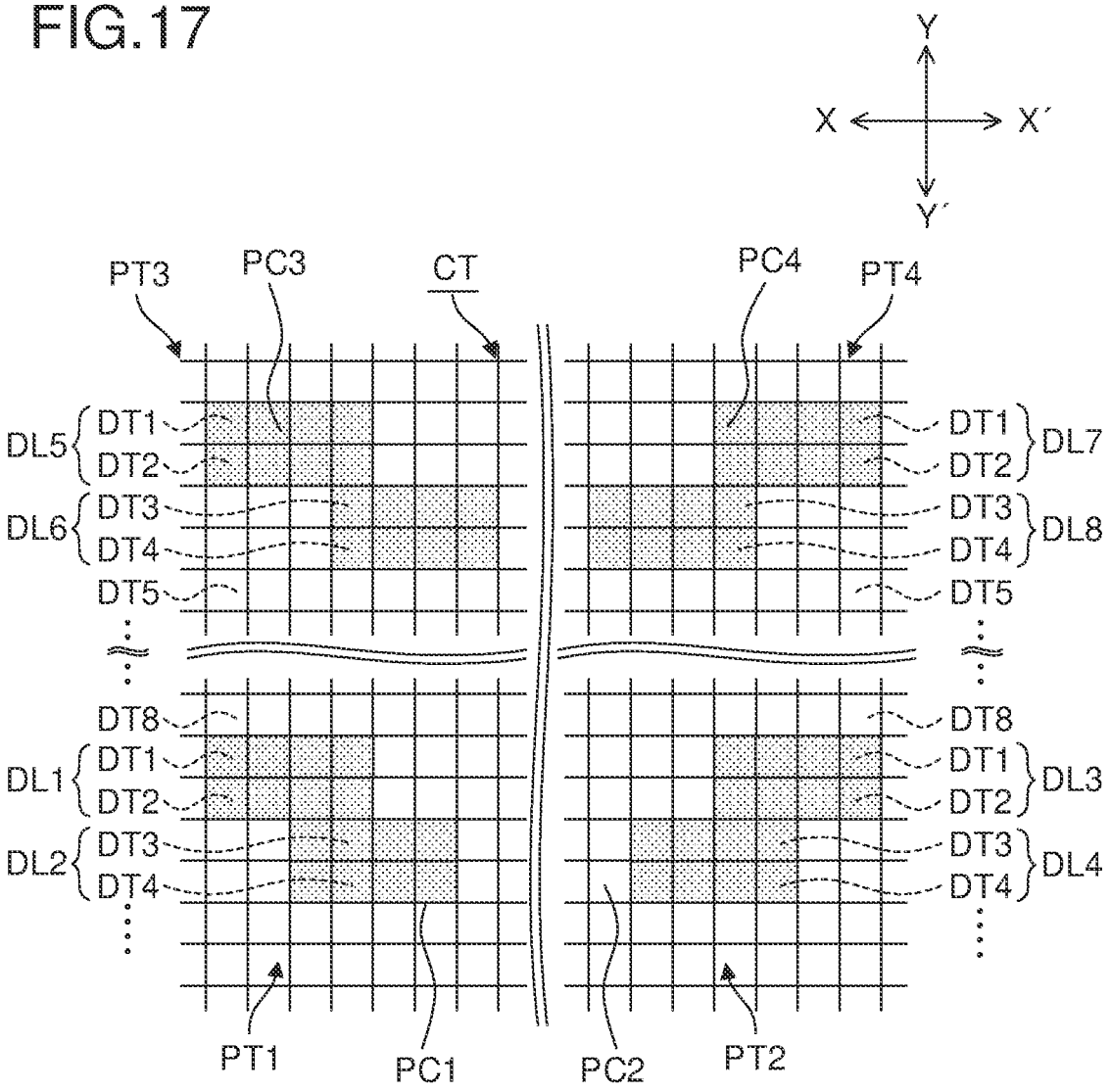
FIG. 17 is a plan view showing a variation of the evaluation chart in the first embodiment of the present disclosure.

Moreover, for the third evaluation patch PC3, a shape is adopted in which the amount of dot displacement of the sixth dot row DL6 with respect to the fifth dot row DL5 in the main scanning direction is lower than the amount of dot displacement of the first dot row DL1 with respect to the second dot row DL2 in the main scanning direction by one dot to the downstream side in the main scanning direction (where the sixth dot row DL6 is displaced with respect to the fifth dot row DL5 to the downstream side in the main scanning direction by three dots), and for the fourth evaluation patch PC, the shape of FIG. 17 described above (where the eighth dot row DL8 is displaced with respect to the seventh dot row DL7 to the upstream side in the main scanning direction by three dots) can be adopted. In this case, it is likewise possible to calculate the displacement such as jitter from the first density difference and the second' density difference.

An image forming apparatus 100 according to a second embodiment will then be described. Differences from the first embodiment will be described below, the same configurations as in the first embodiment are identified with the same symbols and the description thereof is omitted.

Figure 18:
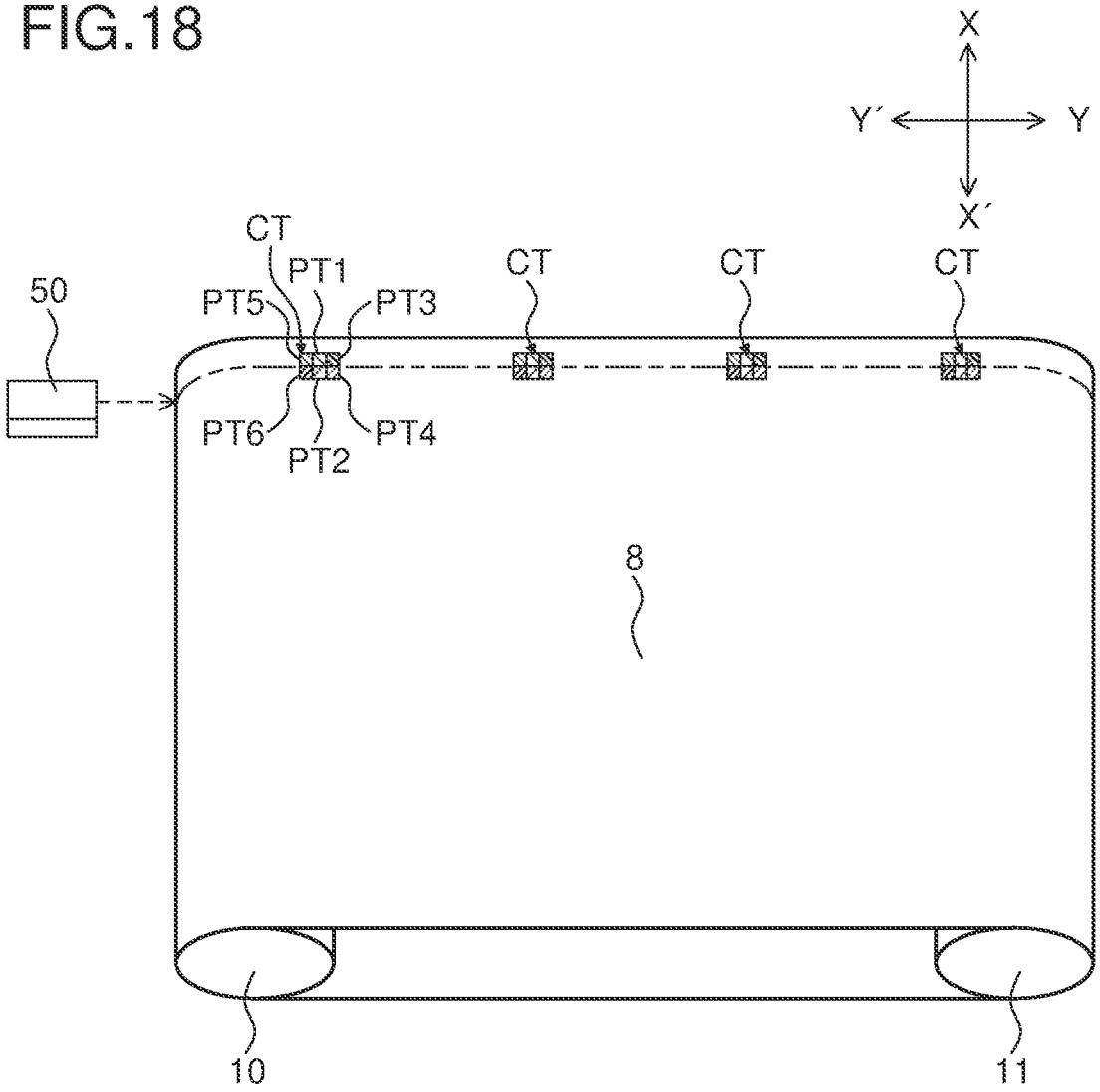
FIG. 18 is a perspective view showing an intermediate transfer belt on which evaluation charts in the second embodiment of the present disclosure are formed.

In the evaluation chart CT of the second embodiment, as shown in FIG. 18, a fifth evaluation pattern PT5 and a sixth evaluation pattern PT6 which are separate from the first to fourth evaluation patterns PT1 to PT4 are included.

In the third evaluation patch PC3 of the present embodiment, the amount of dot displacement of the sixth dot row DL6 with respect to the fifth dot row DL5 in the main scanning direction is higher than the amount of dot displacement of the first dot row DL1 with respect to the second dot row DL2 in the main scanning direction by one dot to the downstream side in the main scanning direction (where the sixth dot row DL6 is displaced with respect to the fifth dot row DL5 to the downstream side in the main scanning direction by three dots). In the fourth evaluation patch PC4, the amount of dot displacement of the eighth dot row DL8 with respect to the seventh dot row DL7 in the main scanning direction is lower than the amount of dot displacement of the fourth dot row DL4 with respect to the third dot row DL3 in the main scanning direction by one dot to the upstream side in the main scanning direction (where the eighth dot row DL8 is displaced with respect to the seventh dot row DL7 to the upstream side in the main scanning direction by one dot).

As shown in FIG. 18, the fifth evaluation pattern PT5 is formed adjacent to the downstream side of the first evaluation pattern PT1 in the subscanning direction. The sixth evaluation pattern PT6 is arranged adjacent to the downstream side of the second evaluation pattern PT2 in the subscanning direction. The sixth evaluation pattern PT6 is adjacent to the downstream side of the fifth evaluation pattern PT5 in the main scanning direction.

Figure 19:
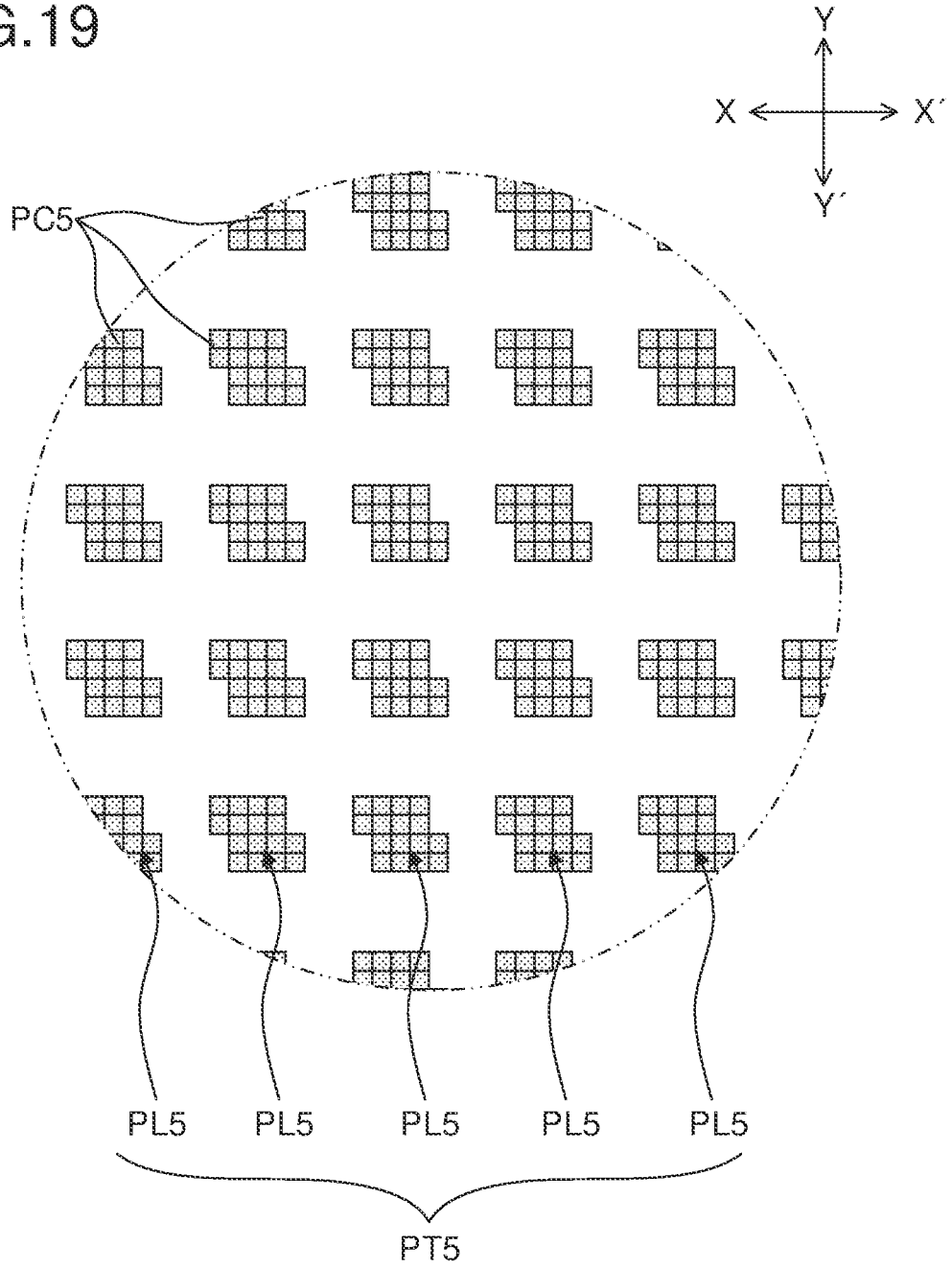
FIG. 19 is an enlarged plan view of a part of a fifth evaluation pattern shown in FIG. 18.
Figure 20:
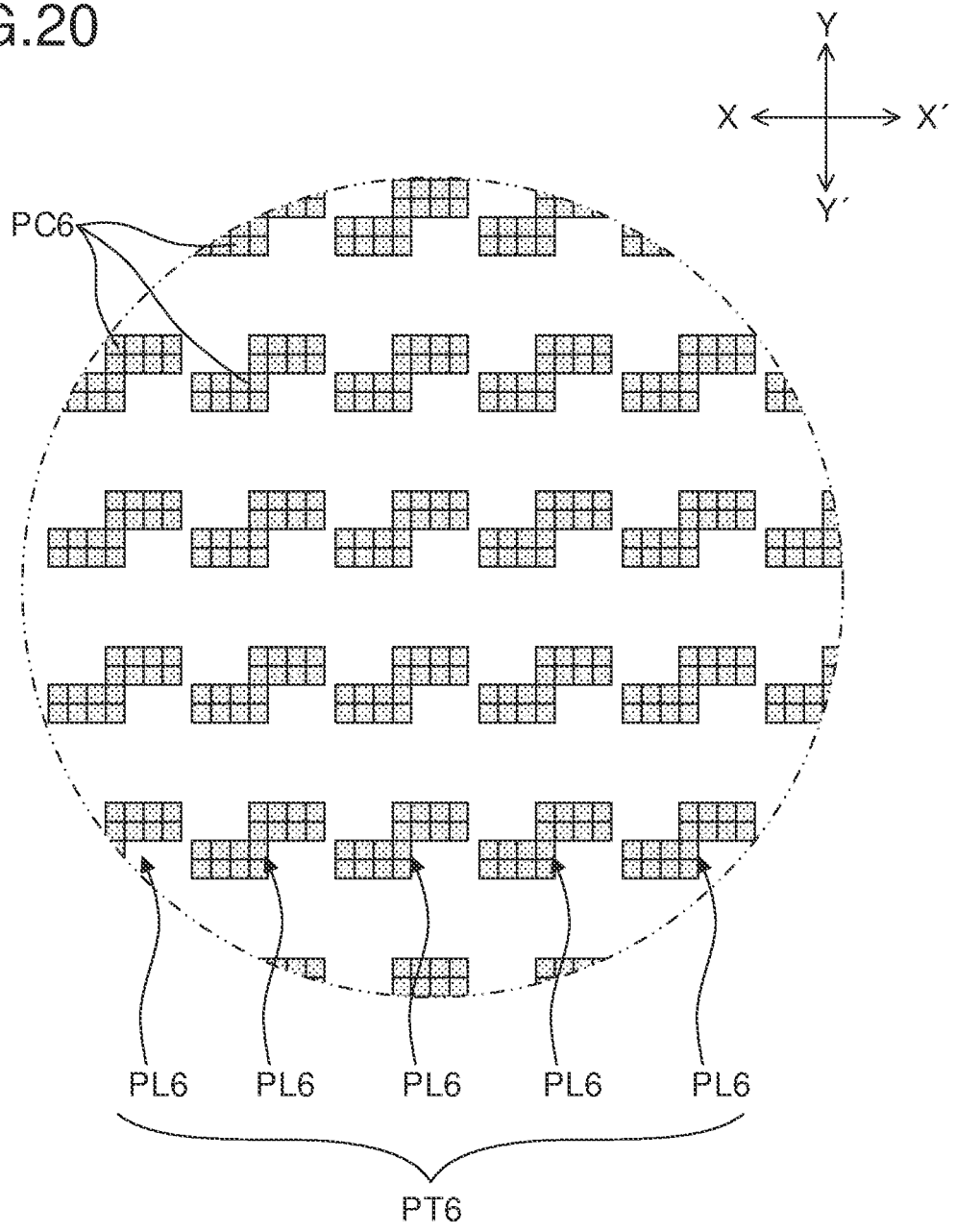
FIG. 20 is an enlarged plan view of a part of a sixth evaluation pattern shown in FIG. 18.
Figure 21:
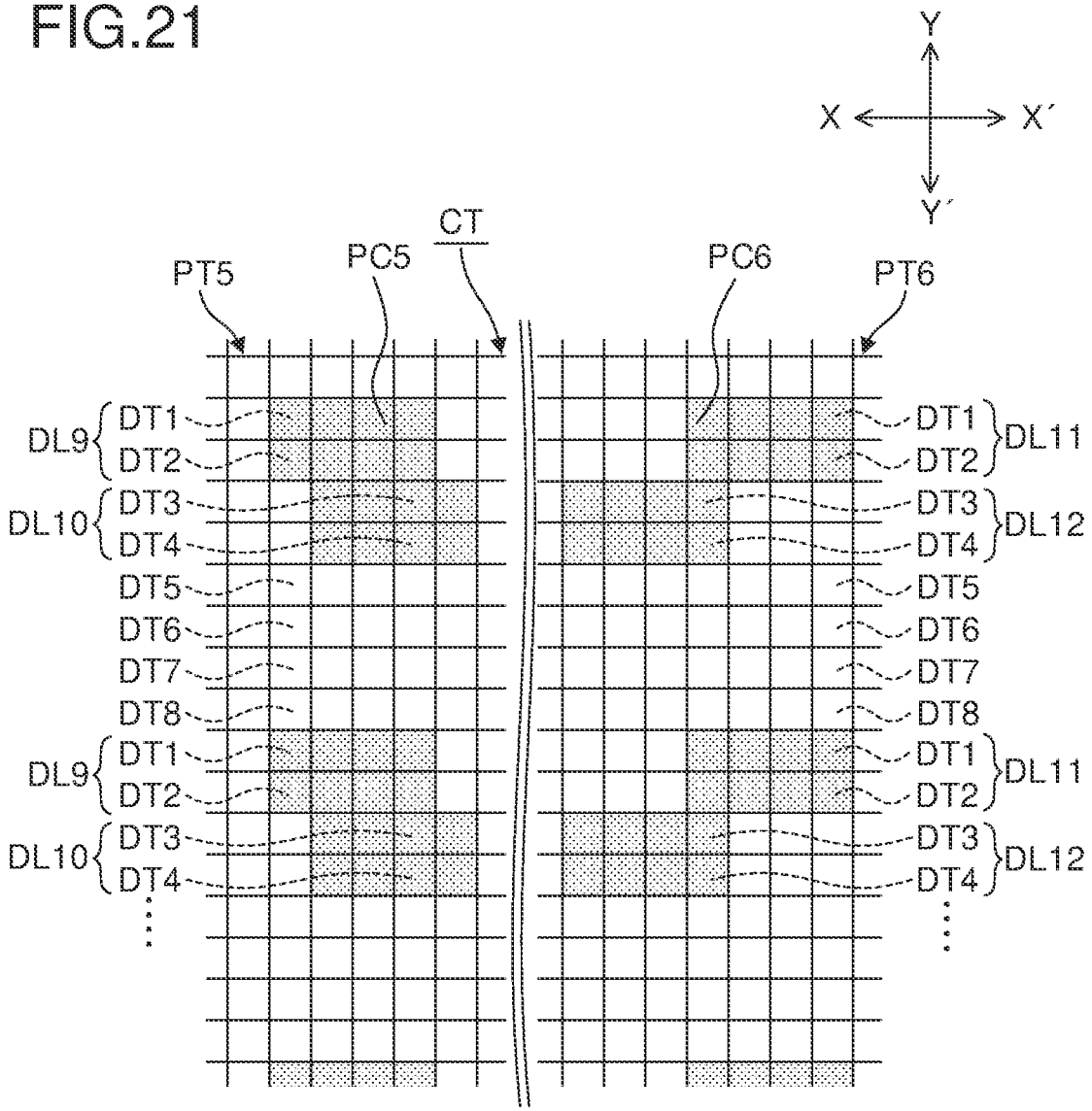
FIG. 21 is an enlarged plan view of a fifth evaluation patch and a sixth evaluation patch.

FIG. 19 is an enlarged plan view of a part of the fifth evaluation pattern PT5 shown in FIG. 18. FIG. 20 is an enlarged plan view of a part of the sixth evaluation pattern PT6. FIG. 21 is an enlarged plan view of a part of a fifth evaluation patch PC5 and a sixth evaluation patch PC6. As shown in FIGS. 19 and 21, the fifth evaluation patch PC5 includes a ninth dot row DL9 and a tenth dot row DL10. The ninth dot row DL9 and the tenth dot row DL10 are rows of dots DT1 and DT2 and dots DT3 and DT4 drawn linearly and continuously such that each of the ninth dot row DL9 and the tenth dot row DL10 has a length corresponding to two dots in the subscanning direction and a length corresponding to four dots in the main scanning direction.

The tenth dot row DL10 is continuously connected to the downstream side of the ninth dot row DL9 in the subscanning direction. The tenth dot row DL10 is displaced a predetermined number of dots (here, one dot) with respect to the ninth dot row DL9 to the downstream side in the main scanning direction. In other words, the amount of dot displacement of the tenth dot row DL10 with respect to the ninth dot row DL9 in the main scanning direction is lower than the amount of dot displacement (2 dots, see FIG. 11) of the second dot row DL2 with respect to the first dot row DL1 in the main scanning direction by one dot (first dot number) in the main scanning direction.

As shown in FIGS. 20 and 21, the sixth evaluation patch PC6 includes an eleventh dot row DL11 and a twelfth dot row DL12. The eleventh dot row DL11 and the twelfth dot row DL12 are rows of dots DT1 and DT2 and dots DT3 and DT4 drawn linearly and continuously such that each of the eleventh dot row DL11 and the twelfth dot row DL12 has a length corresponding to two dots in the subscanning direction and a length corresponding to four dots in the main scanning direction.

The twelfth dot row DL12 is continuously connected to the downstream side of the eleventh dot row DL11 in the subscanning direction. The twelfth dot row DL12 is displaced a predetermined number of dots (here, one dot) with respect to the eleventh dot row DL11 to the upstream side in the main scanning direction. In other words, the amount of dot displacement of the twelfth dot row DL12 with respect to the eleventh dot row DL11 in the main scanning direction is higher than the amount of dot displacement (2 dots, see FIG. 11) of the fourth dot row DL4 with respect to the third dot row DL3 in the main scanning direction by one dot (first dot number) to the upstream side in the main scanning direction.

As described above, the fifth evaluation pattern PT5 and the sixth evaluation pattern PT6 are adjacent to each other in the main scanning direction. Hence, the laser diodes LD3 and LD4 sequentially form the tenth dot row DL10 and the twelfth dot row DL12 in the same scanning. For the timing at which the laser diodes LD3 and LD4 emit light (timing at which the light beams LB3 and LB4 are emitted), the control portion 90 makes light emission timing for drawing the tenth dot row DL10 and the twelfth dot row DL12 earlier than light emission timing for drawing the first dot row DL1 and the third dot row DL3 by a time corresponding to one dot in the main scanning direction.

The control portion 90 calculates a difference value (first density difference) between an image density in the first evaluation pattern PT1 and an image density in the second evaluation pattern PT2, a difference value (second density difference) between an image density in the third evaluation pattern PT3 and an image density in the fourth evaluation pattern PT4 and a difference value (third density difference) between an image density in the fifth evaluation pattern PT5 and an image density in the sixth evaluation pattern PT6. With the first density difference, the second density difference or the third density difference, by the same method as in the first embodiment described above, it is possible to calculate the amount of dot displacement such as jitter.

Here, in the fifth evaluation pattern PT5 and the sixth evaluation pattern PT6, the direction of the specified displacement described above is reversed with respect to the third evaluation pattern PT3 and the fourth evaluation pattern PT4. Specifically, the specified displacement of the tenth dot row DL10 and the twelfth dot row DL12 is one dot to the upstream side (– side) in the main scanning direction. When the displacement such as jitter is a displacement to the downstream side (+ side) in the main scanning direction, the first density difference and the third development density difference are used whereas when the displacement such as jitter is a displacement to the upstream side (– side) in the main scanning direction, the first density difference and the second density difference are used, and thus the amount of dot displacement such as jitter is calculated, with the result that it is possible to more accurately calculate the amount of dot displacement such as jitter. In the control portion 90, the first to third density differences can be simultaneously calculated from one evaluation chart CT, the amount of dot displacement calculated from the first density difference and the second density difference and the amount of dot displacement calculated from the first density difference and the third density difference are compared and thus it is possible to select the optimal amount of dot displacement.

Figure 22:
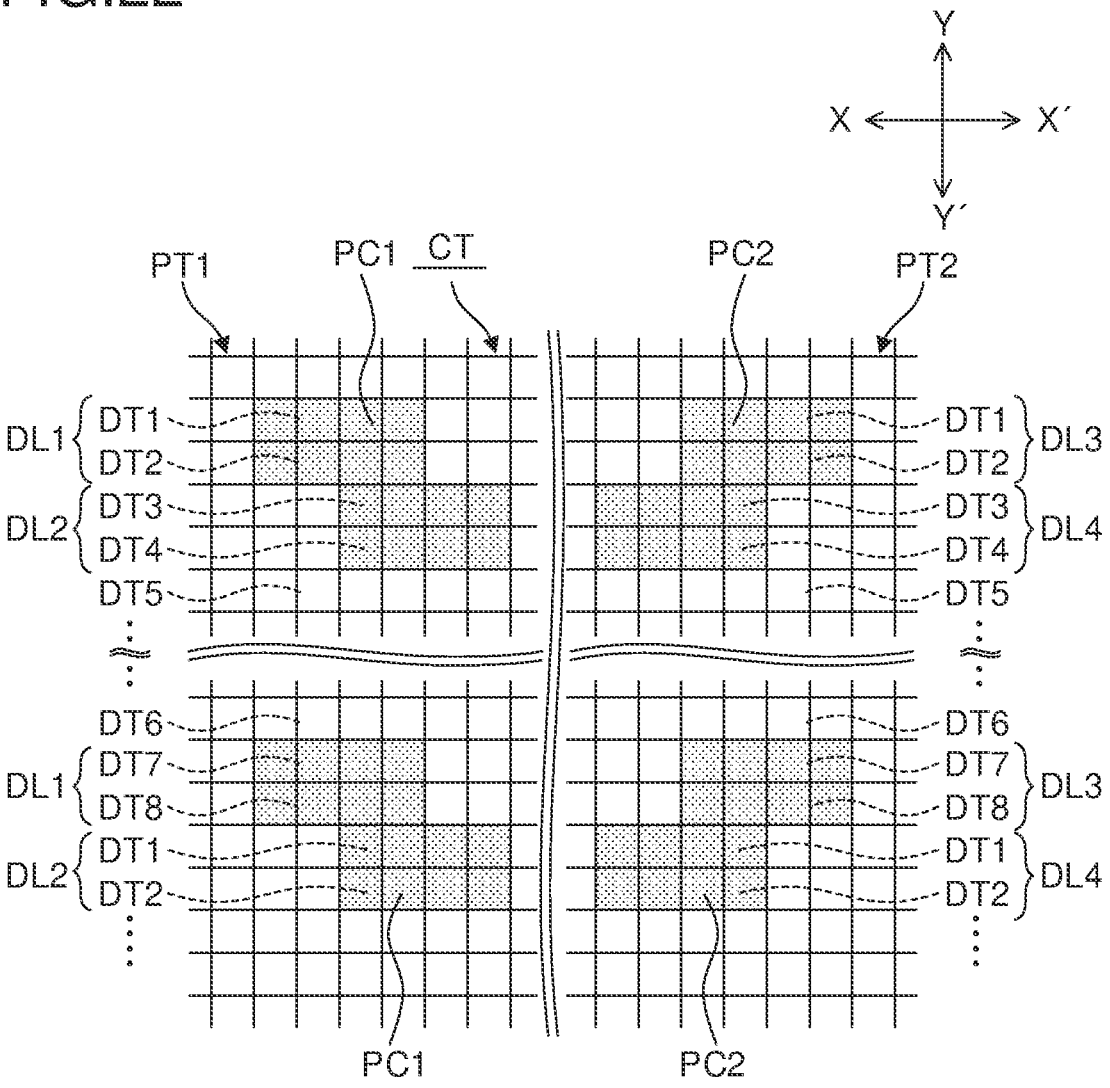
FIG. 22 is an enlarged plan view of a first evaluation pattern and a second evaluation pattern in an evaluation chart in the third embodiment of the present disclosure.

The image forming apparatus 100 of a third embodiment will then be described. FIG. 22 is an enlarged plan view of the first evaluation pattern PT1 and the second evaluation pattern PT2 in the evaluation chart of the third embodiment. The evaluation chart CT of the present embodiment includes first to sixth evaluation patterns PT1 to PT6 (an upper part shown in the figure) which are formed by focusing all the light beams LB1 to LB8 to form an image on a predetermined first deflection surface 63*a* (hereinafter referred to as "identical surface scanning") and first to sixth evaluation patterns PT1 to PT6 (a lower part shown in the figure) which are formed by focusing a part of the light beams LB1 to LB8 to form an image on the predetermined first deflection surface 63*a* and focusing the remaining beams of the light beams LB1 to LB8 to form an image on a second deflection surface 63*b* adjacent to the first deflection surface 63*a* (hereinafter referred to as "different scanning surface scanning").

The different scanning surface scanning will be described in more detail. Among the light beams LB1 to LB8, the light beams LB (here, the light beams LB7 and LB8) for drawing the first dot row DL1, the third dot row DL3, the fifth dot row DL5, the seventh dot row DL7, the ninth dot row DL9 and the eleventh dot row DL11 are focused on the first deflection surface 63*a* as an image, and the light beams LB (here, the light beams LB1 and LB2) for drawing the second dot row DL2, the fourth dot row DL4, the sixth dot row DL6, the eighth dot row DL8, the tenth dot row DL10 and the twelfth dot row DL12 are focused on the second deflection surface 63*b* as an image (the third to sixth evaluation pattern PT3 to PT6 are omitted).

Here, in the first evaluation pattern PT1 (identical surface first evaluation pattern) and the second evaluation pattern PT2 (identical surface second evaluation pattern) formed by the identical surface scanning, a difference in image density therebetween is assumed to be an identical surface first density difference. In the first evaluation pattern PT1 (different scanning surface first evaluation pattern) and the second evaluation pattern PT2 (different scanning surface second evaluation pattern) formed by the different scanning surface scanning, a difference in image density therebetween is assumed to be a different scanning surface first density difference.

In the image forming apparatus 100 of the present embodiment, a density difference correction value is calculated from the identical surface first density difference and the different scanning surface first density difference, and the density difference correction value is subtracted from the first to third density differences calculated in the embodiments described above, with the result that it is possible to more accurately calculate the amount of dot displacement such as jitter.

Figure 23:
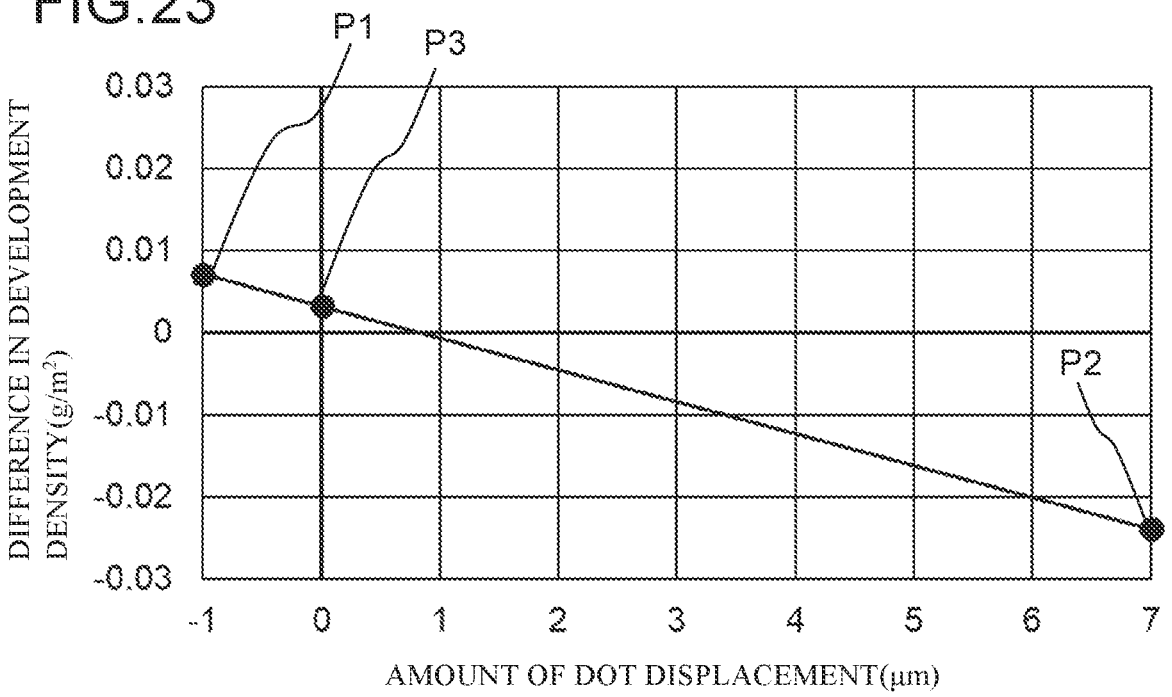
FIG. 23 is a graph showing a relationship between the amount of position displacement and a difference in development density.

A method for calculating the density difference correction value described above will be described below using the graph of FIG. 23. FIG. 23 is a graph showing a relationship between the magnitude of a specified displacement and a difference in development density. The horizontal axis represents the magnitude of the specified displacement (μm). The vertical axis represents the value of the difference in development density between evaluation patterns adjacent in the main scanning direction.

For example, when a distance between the dots DT1 and the dots DT8 in the main scanning direction was set to −13.125 μm such that the displacement such as jitter was imitated, the identical surface first density difference was 0.0072 (g/cm$^2$), and the different scanning surface first density difference was −0.0238 (g/cm$^2$). Here, when in the identical surface scanning, the dots DT1 and the dots DT8 are displaced to the upstream side (− side) in the main scanning direction by 1 μm, in the different scanning surface scanning, the dots DT1 and the dots DT8 are displaced to the downstream side (+ side) in the main scanning direction by 7 μm. Hence, in the identical surface scanning, the Point P1 is plotted on the graph of FIG. 23 with the horizontal axis set to −1 and the vertical axis set to the identical surface first density difference, and in the different scanning surface scanning, the Point P2 is plotted on the graph with the horizontal axis set to 7 and the vertical axis set to the different scanning surface first density difference. Specifically, the coordinates (X, Y) of the point P1 are (−1, 0.0072), and the coordinates (X, Y) of the point P2 are (7, −0.0238). In this case, a y-intercept P3 is 0.00328. When the distance between the dots DT1 and the dots DT8 in the main scanning direction is set to −13.125 μm, the y-intercept P3 is the density difference correction value. The density difference correction value described above is subtracted from the first density difference, the second density difference and the third density difference.

Figure 16:
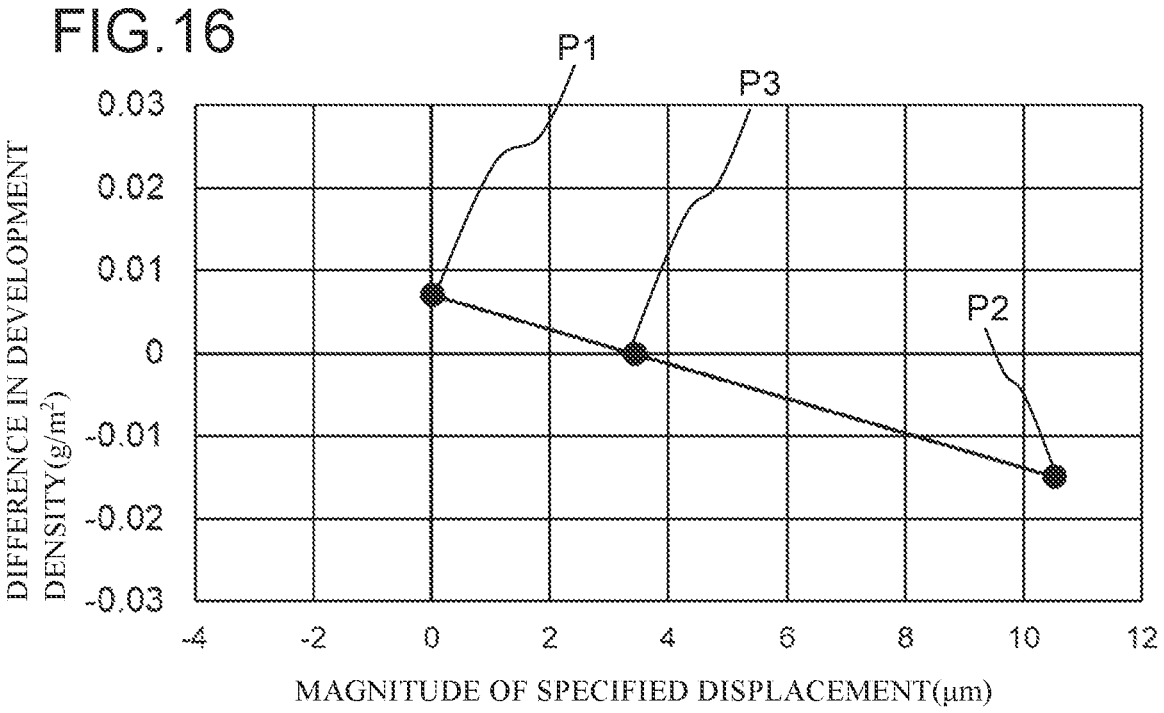
FIG. 16 is a graph showing a relationship between the amount of position displacement and a difference in development density.

If the method using the graph of FIG. 16 described above is adopted without use of the density difference correction value described above, and thus the amount of dot displacement such as jitter is calculated from the identical surface first density difference and the identical surface second density difference (the second density difference in the identical surface scanning), the amount of dot displacement such as jitter is −3.4188 μm. When in this value, the density difference correction value described above is subtracted from the first to third density differences, and this is used to calculate the amount of dot displacement such as jitter by using the method described above (method for calculating the y-intercept by using the graph of FIG. 16), the amount of dot displacement is −1.8514 μm. In this case, the distance between the dots DT1 and the dots DT8 in the main scanning direction is −13.125 μm, and when a value obtained by dividing −13.125 μm by a value (the number of gaps between the adjacent laser diodes LD1 to LD8) obtained by subtracting 1 from 8 serving as the number of laser diodes LD1 to LD8 is assumed to be the amount of dot displacement, the value is −1.875 μm. Hence, as compared with the calculated value (−3.4188 μm) before the correction, the calculated value (−1.8514 μm) after the correction is close to the amount of dot displacement.

Here, in a conventional image forming apparatus 100, for each of a plurality of types of evaluation charts, evaluation charts are sequentially formed by displacing dots in the main scanning direction by a predetermined amount, changes in the image density of each of the evaluation charts are detected and thus a dot displacement is detected. Hence, for each of the evaluation charts CT, a plurality of evaluation charts having different amounts of dot displacement are formed, and thus it is necessary to form a huge number of evaluation charts, with the result that the detection of the image density is complicated.

On the other hand, in the image forming apparatus 100 of the present disclosure, the evaluation chart CT in each of the embodiments is adopted, and thus it is possible to use one evaluation chart to compare image densities in evaluation patterns PT having a plurality of amounts of dot displacement, with the result that it is possible to accurately adjust the dot displacement with a small number of evaluation charts.

The evaluation chart CT of the third embodiment is adopted, and thus it is possible to determine the density difference correction value with which the magnitude of the dot displacement can be more accurately detected. Hence, it is possible to more accurately adjust the dot displacement.

Figure 24:
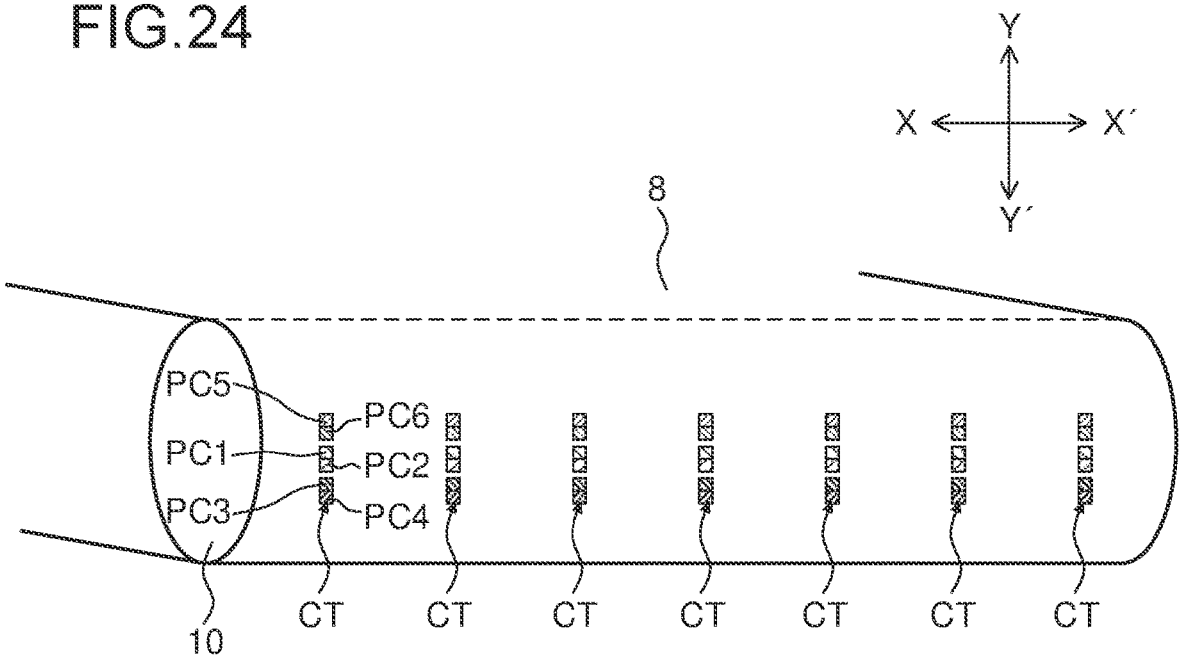
FIG. 24 is a diagram showing a variation of the evaluation chart in the present disclosure.

The present disclosure is not limited to the embodiments described above, and various variations can be made without departing from the spirit of the present disclosure. For example, as shown in FIG. 24, a plurality of evaluation charts CT may be arranged at predetermined equal intervals in the main scanning direction of the intermediate transfer belt 8. In this way, it is possible to detect changes in image density at a plurality of locations in the main scanning direction. Hence, even when a dot displacement in which the amount of displacement is different occurs in each position in the main scanning direction, it is possible to appropriately correct the dot displacement in each position in the main scanning direction. In this case, as shown in FIG. 24, the evaluation patterns PT1 to PT6 can be linearly arranged in the subscanning direction. The color displacement correction portion 97 in this case detects an image density in each of the evaluation charts CT with the center portion of the evaluation chart CT in the main scanning direction set as a reference position.

In this case, a configuration can also be adopted in which instead of the image density sensor 50 described previously, a scanner (not shown) included in the image forming apparatus 100 is used to scan a plurality of evaluation charts CT on the intermediate transfer belt 8 at a time and thereby detect image densities. In this case, it is possible to detect dot displacements in the positions in the main scanning direction at a time, and thus it is possible to more easily correct the dot displacements.

The effects of the present disclosure will be described in further detail below using Example.

EXAMPLE

In evaluation charts CT, changes in image density in each form of the evaluation pattern were investigated by an analytical method. As conditions, image densities (%) when the light scanning device 5 shown in FIG. 2 was installed in the image forming apparatus 100 shown in FIG. 1, the evaluation charts CT in the first and third embodiments of the present disclosure were drawn on print sheets (recording media) were calculated by the analytical method, and thus results obtained by sequentially displacing the positions of dots in the main scanning direction were compared. Here, among the evaluation charts CT in the first embodiment, the evaluation chart having the shape shown in FIG. 14 was adopted (where the sixth dot row DL6 was displaced with respect to the fifth dot row DL5 to the downstream side in the main scanning direction by three dots and the eighth dot row DL8 was displaced with respect to the seventh dot row DL7 to the upstream side in the main scanning direction by one dot).

In a test, the amount of dot displacement (distance between the dots DT1 and the dots DT8 in the main scanning direction) was sequentially changed from −21 μm to 21 μm or less, and thus a state where a displacement such as jitter occurred in a pseudo manner was achieved. Here, changes in development ratio (%) (when the entire evaluation pattern PT was drawn in black, and an image density (ratio of an area occupied by a black part to the entire evaluation pattern PT) was assumed to be one, the ratio of an image density to the evaluation pattern PT) were calculated (see FIG. 25). The amount of dot displacement was adjusted by changing timing at which the laser diodes LD1 to LD8 emit light. In the amount of dot displacement, a displacement in the main scanning direction was assumed to be +, and a displacement in a direction opposite to the main scanning direction was assumed to be −. For the difference value of development ratios in the evaluation patterns PT1 to PT6 adjacent in the main scanning direction, a transition caused by changes in the amount of dot displacement was calculated (see FIG. 26).

Figure 25:
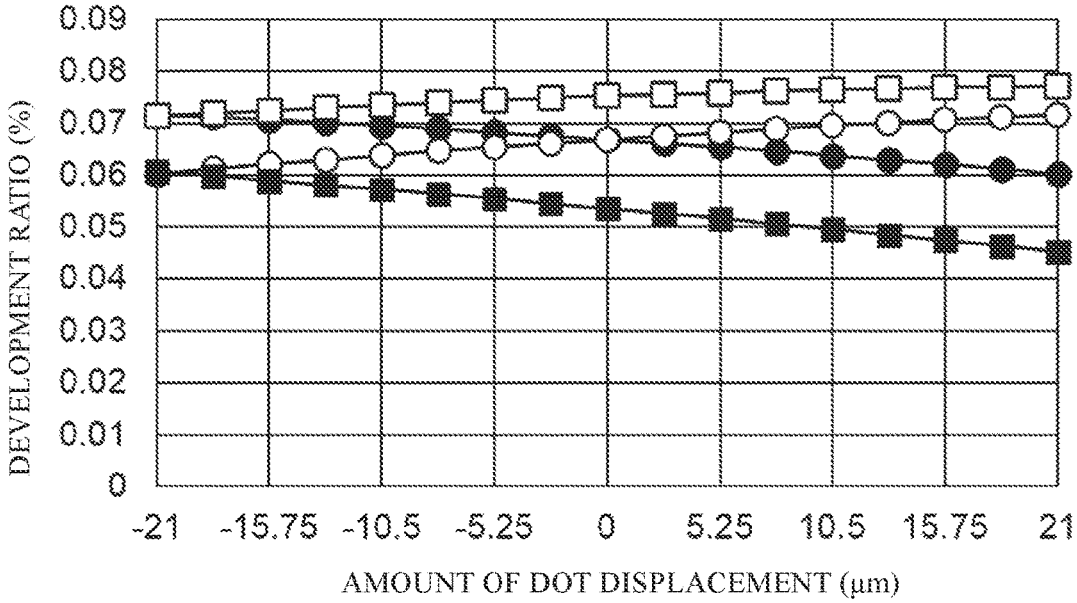
FIG. 25 is a graph showing changes in development ratio in evaluation patterns when the evaluation chart of the first embodiment was used.

FIG. 25 is a graph showing changes in development ratio in the evaluation patterns PT1 to PT4 when the evaluation chart CT of the first embodiment was used. In FIG. 25, the first evaluation pattern PT1 was indicated by the graph of ●, the second evaluation pattern PT2 was indicated by the graph of ○, the third evaluation pattern PT3 was indicated by the graph of ■ and the fourth evaluation pattern PT4 was indicated by the graph of □.

As shown in FIG. 25, the first evaluation pattern PT1 and the third evaluation pattern PT were downward-sloping graphs whereas the second evaluation pattern PT2 and the fourth evaluation pattern PT4 were upward-sloping graphs. This is because since the first evaluation pattern PT1 and the second evaluation pattern PT2 were symmetrical in the left/right direction (see FIGS. 11 and 14), the first evaluation pattern PT1 and the second evaluation pattern PT2 were in a relationship in which the direction of changes in development ratio with respect to changes in the amount of displacement in the main scanning direction was reversed.

Specifically, in the first evaluation pattern PT1, the second dot row DL2 was previously displaced with respect to the first dot row DL1 to the downstream side (+ side) in the main scanning direction (see FIG. 11). Hence, as the amount of dot displacement was increased, the dot displacement between the first dot row DL1 and the second dot row DL2 was gradually increased. Then, the image density in the first evaluation patch PC1 alone was lowered, and thus the development ratio in the first evaluation pattern PT1 was also lowered. On the other hand, in the second evaluation pattern PT2, the fourth dot row DL4 was previously displaced with respect to the third dot row DL3 to the upstream side (− side) in the main scanning direction (see FIG. 14). Hence, as the amount of dot displacement was increased, the dot displacement between the second dot row DL2 and the third dot row DL3 was gradually decreased. Then, the image density in the second evaluation patch PC2 alone was increased, and thus the development ratio in the second evaluation pattern PT2 was also increased. The third evaluation pattern PT3 and the fourth evaluation pattern PT4 had the same relationship.

Figure 26:
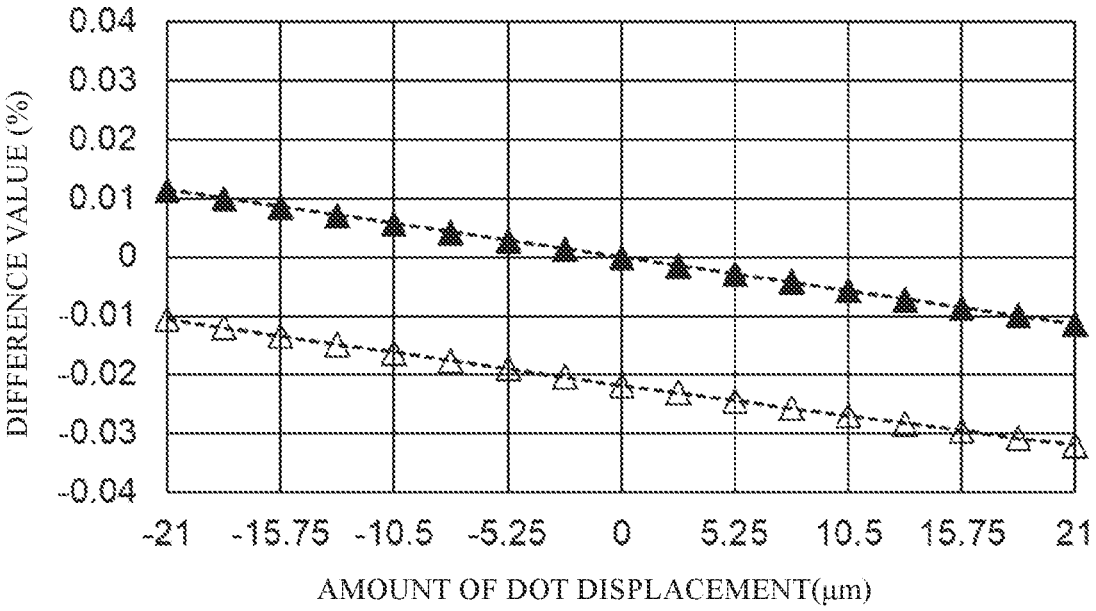
FIG. 26 is a graph showing a difference value between the first evaluation pattern and the second evaluation pattern and a difference value between the third evaluation pattern and the fourth evaluation pattern when the evaluation chart of the first embodiment was used.

FIG. 26 is a graph showing a difference value 1 (the graph of ▲) in development ratio between the first evaluation pattern PT1 and the second evaluation pattern PT2 and a difference value 2 (the graph of Δ) in development ratio between the third evaluation pattern PT3 and the fourth evaluation pattern PT4 when the evaluation chart CT of the first embodiment was used. As shown in FIG. 26, as the amount of dot displacement was increased to the downstream side in the main scanning direction, the difference value 1 and the difference value 2 were gradually lowered. Since the first evaluation pattern PT1 and the second evaluation pattern PT2 were laterally symmetrical in the main scanning direction, when the amount of dot displacement in the main scanning direction was zero, the difference value was also zero. On the other hand, since the third evaluation pattern PT3 and the fourth evaluation pattern PT4 were asymmetrical in the main scanning direction, even when the amount of dot displacement in the main scanning direction was zero, the difference value was not zero.

Figure 27:
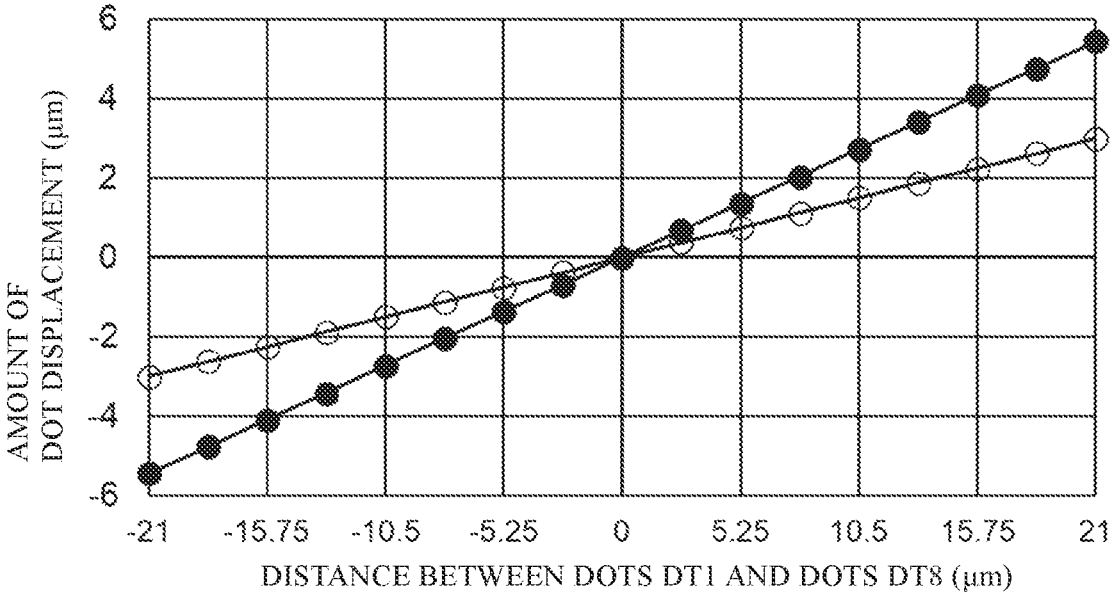
FIG. 27 is a graph showing changes in an actual displacement such as jitter and a displacement such as jitter calculated from changes in each difference value.

FIG. 27 is a graph showing changes in an actual displacement such as jitter and changes in a displacement such as jitter calculated from changes in the difference value 1 and the difference value 2. The difference value 1 was assumed to be the first density difference described previously, the difference value 2 was assumed to be the second density difference described previously, and thus a calculation was performed by the method described previously. The actual displacement such as jitter (distance between the dots DT1 and the dots DT8) was indicated by the graph of ○, and the amount of displacement such as jitter calculated from the difference values 1 and 2 by the method of the first embodiment was indicated by the graph of ●. As shown in FIG. 27, along changes in the actual displacement such as jitter, the value of the displacement such as jitter calculated from the difference values 1 and 2 was changed. Hence, it was confirmed that with the evaluation chart CT of the first embodiment, an approximate value for the displacement such as jitter can be calculated from the difference value 1 (first density) and the difference value 2 (second density).

Figure 28:
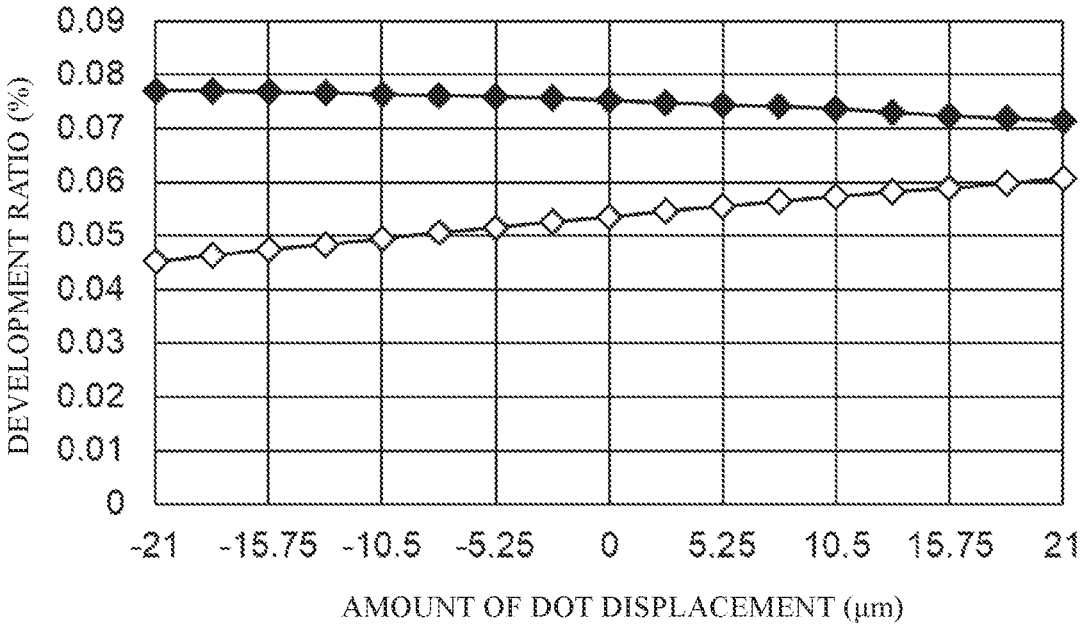
FIG. 28 is a graph showing changes in development ratio in the fifth evaluation pattern and the sixth evaluation pattern when the evaluation chart of the second embodiment was used.

FIG. 28 is a graph showing changes in development ratio in the fifth evaluation pattern PT5 and the sixth evaluation pattern PT6 when the evaluation chart CT of the third embodiment was used. In FIG. 28, the fifth evaluation pattern PT5 was indicated by the graph of ♦, and the sixth evaluation pattern PT6 was indicated by the graph of ◇. The first to fourth evaluation patterns PT1 to PT4 of the third embodiment had the same shapes as those in the first embodiment. Hence, the development ratios thereof were the same as those indicated by the graph of FIG. 26. Therefore, in FIG. 28, the graphs of the first to fourth evaluation patterns PT1 to PT4 were omitted.

As shown in FIG. 28, the graph (the graph of ♦) of the fifth evaluation pattern PT5 was a downward-sloping graph whereas the graph (the graph of ◇) of the sixth evaluation pattern PT6 was an upward-sloping graph.

Figure 29:
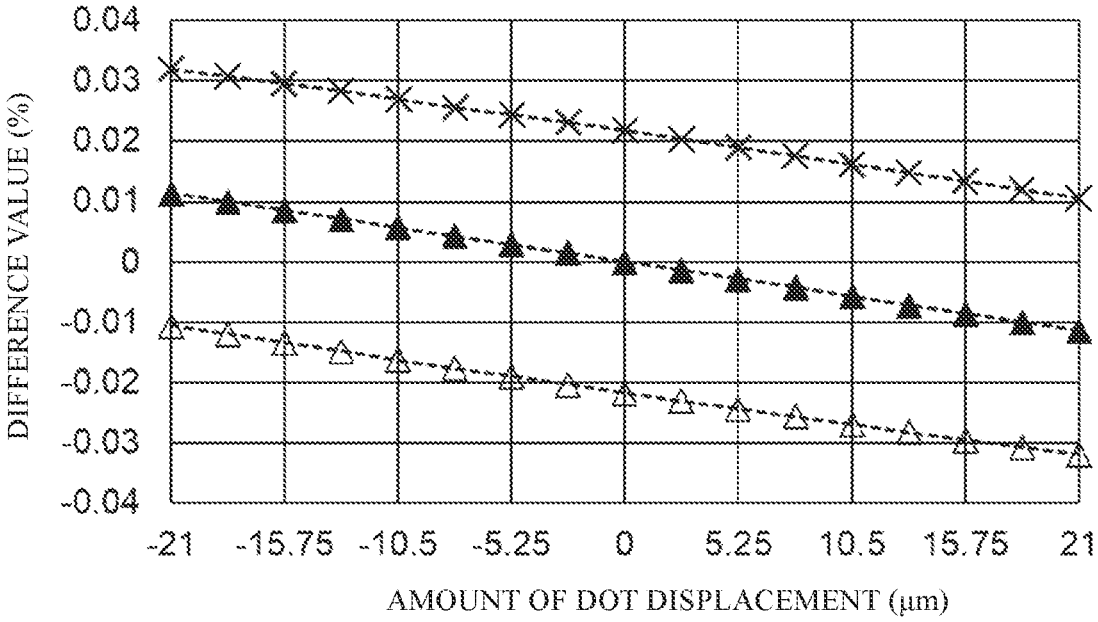
FIG. 29 is a graph showing difference values when the evaluation chart of the second embodiment was used.

FIG. 29 is a graph showing the difference value 1 (the graph of ▲) and the difference value 2 (the graph of Δ) when the evaluation chart CT of the second embodiment was used and a difference value 3 (the graph of x) in development ratio between the fifth evaluation pattern PT5 and the sixth evaluation pattern PT6.

Figure 30:
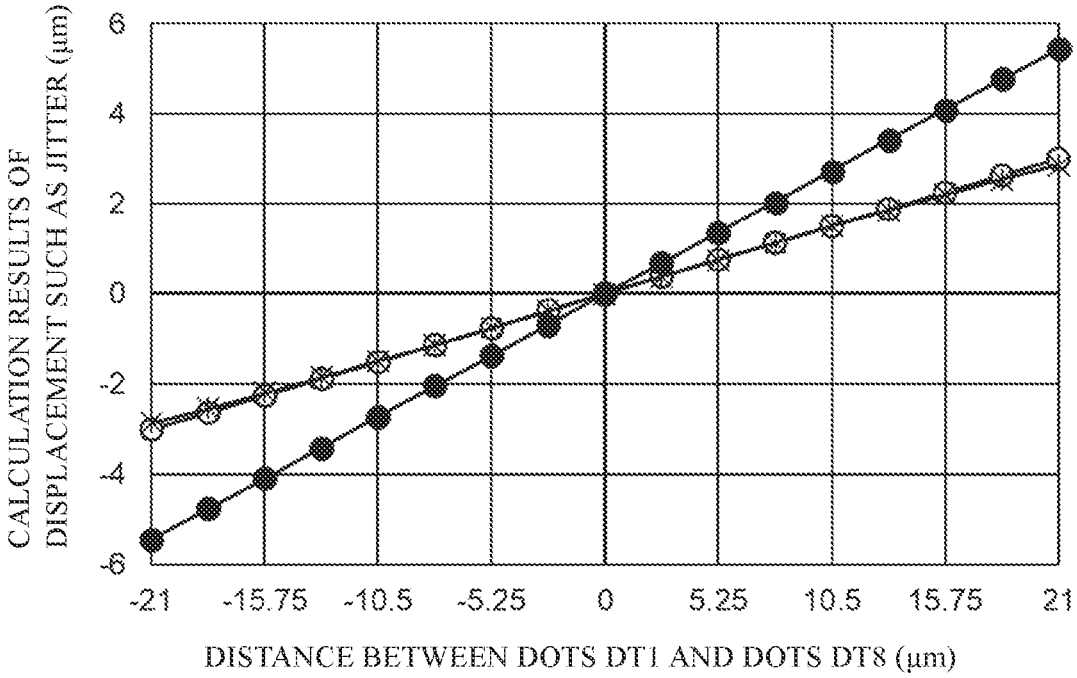
FIG. 30 is a graph showing the calculated value of a displacement such as jitter which was corrected with a density difference correction value in the third embodiment and the calculated value of the displacement such as jitter which was not corrected with the density difference correction value.

FIG. 30 is a graph showing the calculated value of the displacement such as jitter which was corrected with the density difference correction value in the third embodiment and the calculated value of the displacement such as jitter which was not corrected with the density difference correction value. The value of the actual displacement such as jitter was indicated by the graph of ○. The amount of displacement such as jitter calculated from the difference values 1 and 2 by the method of the first embodiment without being corrected with the density difference correction value was indicated by the graph of ●. A density difference correction value was calculated by the method described previously, and a displacement such as jitter calculated by correcting the difference values 1 to 3 with the density difference correction value was indicated by the graph of *.

As shown in FIG. 30, as compared with the calculated value (value indicated by the graph of ●) of a displacement such as jitter which was not corrected, the calculated value (value indicated by the graph of *) of a displacement such as jitter which was corrected was close to the actual displacement such as jitter (value indicated by the graph of ○). Therefore, the density difference correction value is subtracted from each of the difference values (the first to third density differences), each of the difference values (the first to third density differences) is corrected and thus it is possible to more accurately calculate the amount of dot displacement such as jitter.

The present disclosure can be utilized for an image forming apparatus which adopts a multi-beam method of scanning light beams over a photoconductive drum from a multi-beam laser having a plurality of light emitters. By utilization of the present disclosure, it is possible to provide an image forming apparatus in which the rate of change in image density in an evaluation chart for color displacement correction is increased and thus a dot position displacement in main scanning can be corrected more accurately.

What is claimed is:

1. An image forming apparatus comprising:

a light scanning device that includes: a light source including a plurality of light-emitting portions which are arranged at a predetermined angle with respect to a main scanning direction in a row at regular intervals; and a polygon mirror which deflects and scans light beams emitted from the light-emitting portions, and that uses the light beams to form an electrostatic latent image on an image carrying member;

a developing portion that forms a toner image by visualizing the electrostatic latent image;

a control portion that controls the light scanning device such that turning on and off of each of the light-emitting portions are switched to form the electrostatic latent image corresponding to image data; and a storage portion that stores an evaluation chart which is formed by dots drawn with the light beams of the light-emitting portions to determine timing at which each of the light-emitting portions starts writing, wherein the evaluation chart includes:

a first evaluation pattern;

a second evaluation pattern that is arranged parallel to the first evaluation pattern in the main scanning direction or a subscanning direction perpendicular to the main scanning direction;

a third evaluation pattern that is arranged parallel to the first evaluation pattern in the main scanning direction or the subscanning direction; and a fourth evaluation pattern that is arranged parallel to the first evaluation pattern in the main scanning direction or the subscanning direction, the first evaluation pattern includes a first patch row that is formed by arranging a plurality of first evaluation patches at equal intervals in the subscanning direction, the first evaluation patch includes:

a first dot row in which one or more dots in the subscanning direction are arranged linearly and continuously in the main scanning direction; and a second dot row in which a number of dots adjacent to the first dot row in the subscanning direction are arranged linearly and continuously in the main scanning direction so as to be displaced with respect to the first dot row, the number being equal to or less than a number obtained by subtracting a number of dots of the first dot row in the subscanning direction from a number of the light-emitting portions, a plurality of the first patch rows are arranged at predetermined equal intervals in the main scanning direction to form the first evaluation pattern, the second evaluation pattern includes a second patch row that is formed by arranging, in the subscanning direction, a plurality of second evaluation patches at same intervals as intervals at which the first evaluation patches are arranged parallel to each other, the second evaluation patch is symmetrical with the first evaluation patch in a direction in which the first evaluation pattern and the second evaluation pattern are arranged parallel to each other, a plurality of the second patch rows are arranged at predetermined equal intervals in the main scanning direction to form the second evaluation pattern, the third evaluation pattern includes a third patch row that is formed by arranging a plurality of third evaluation patches at equal intervals in the subscanning direction, the third evaluation patch includes:

a fifth dot row in which a same number of dots as in the first dot row in the subscanning direction are arranged continuously in the main scanning direction; and a sixth dot row in which a same number of dots as in the second dot row in the subscanning direction are adjacent to the fifth dot row in the subscanning direction and are arranged linearly and continuously in the main scanning direction so as to be displaced with respect to the fifth dot row, a plurality of the third patch rows are arranged at predetermined equal intervals in the main scanning direction to form the third evaluation pattern, the fourth evaluation pattern includes a fourth patch row that is formed by arranging a plurality of fourth evaluation patches at equal intervals in the subscanning direction, the fourth evaluation patch includes:

a seventh dot row in which the same number of dots as in the first dot row in the subscanning direction are arranged continuously in the main scanning direction; and an eighth dot row in which the same number of dots as in the second dot row in the subscanning direction are adjacent to the seventh dot row in the subscanning direction and are arranged linearly and continuously in the main scanning direction so as to be displaced with respect to the seventh dot row, a plurality of the fourth patch rows are arranged at predetermined equal intervals in the main scanning direction to form the fourth evaluation pattern, the displacement of the sixth dot row with respect to the fifth dot row is larger or smaller than the displacement of the second dot row with respect to the first dot row by a predetermined first dot number in the main scanning direction and the displacement of the eighth dot row with respect to the seventh dot row is larger or smaller than the displacement of the fourth dot row with respect to the third dot row by the first dot number in the main scanning direction.

2. The image forming apparatus according to claim 1, wherein the fourth evaluation patch is symmetrical with the third evaluation patch in the direction in which the first evaluation pattern and the second evaluation pattern are arranged parallel to each other.

3. The image forming apparatus according to claim 1, wherein the fourth evaluation patch is asymmetric with the third evaluation patch in the direction in which the first evaluation pattern and the second evaluation pattern are arranged parallel to each other.

4. The image forming apparatus according to claim 3, wherein the evaluation chart includes a fifth evaluation pattern and a sixth evaluation pattern that are arranged parallel to the first evaluation pattern in the main scanning direction or the subscanning direction, the fifth evaluation pattern includes a fifth patch row that is formed by arranging a plurality of fifth evaluation patches at equal intervals in the subscanning direction, the fifth evaluation patch includes:

a ninth dot row in which the same number of dots as in the first dot row in the subscanning direction are arranged continuously in the main scanning direction; and a tenth dot row in which the same number of dots as in the second dot row in the subscanning direction are adjacent to the ninth dot row in the subscanning direction and are arranged linearly and continuously in the main scanning direction so as to be displaced with respect to the ninth dot row, a plurality of the fifth patch rows are arranged at predetermined equal intervals in the main scanning direction to form the fifth evaluation pattern, the sixth evaluation pattern includes a sixth patch row that is formed by arranging a plurality of sixth evaluation patches at equal intervals in the subscanning direction, the sixth evaluation patch includes:

an eleventh dot row in which the same number of dots as in the first dot row in the subscanning direction are arranged continuously in the main scanning direction; and a twelfth dot row in which the same number of dots as in the second dot row in the subscanning direction are adjacent to the eleventh dot row in the subscanning direction and are arranged linearly and continuously in the main scanning direction so as to be displaced with respect to the eleventh dot row, a plurality of the sixth patch rows are arranged at predetermined equal intervals in the main scanning direction to form the sixth evaluation pattern, the displacement of the sixth dot row with respect to the fifth dot row is larger than the displacement of the second dot row with respect to the first dot row by the first dot number in the main scanning direction, the displacement of the eighth dot row with respect to the seventh dot row is smaller than the displacement of the fourth dot row with respect to the third dot row by the first dot number in the main scanning direction, the displacement of the tenth dot row with respect to the ninth dot row is smaller than the displacement of the second dot row with respect to the first dot row by the first dot number in the main scanning direction and the displacement of the twelfth dot row with respect to the eleventh dot row is larger than the displacement of the fourth dot row with respect to the third dot row by the first dot number in the main scanning direction.

5. The image forming apparatus according to claim 3, further comprising:

a density detection mechanism that detects an image density of the toner image which visualizes the evaluation chart, wherein the control portion displaces timing at which each of the light-emitting portions emits the light beam based on a comparison result obtained by comparing a difference value between an image density in the first evaluation pattern and an image density in the second evaluation pattern detected with the density detection mechanism and a difference value between an image density in the third evaluation pattern and an image density in the fourth evaluation pattern detected with the density detection mechanism.

6. The image forming apparatus according to claim 4, further comprising:

a density detection mechanism that detects an image density of the toner image which visualizes the evaluation chart, wherein the control portion displaces timing at which each of the light-emitting portions emits the light beam based on a comparison result obtained by comparing a difference value between an image density in the first evaluation pattern and an image density in the second evaluation pattern detected with the density detection mechanism, a difference value between an image density in the third evaluation pattern and an image density in the fourth evaluation pattern detected with the density detection mechanism and a difference value between an image density in the fifth evaluation pattern and an image density in the sixth evaluation pattern detected with the density detection mechanism.

7. The image forming apparatus according to claim 5, wherein a plurality of the evaluation charts are arranged at predetermined intervals in the main scanning direction, and the control portion adjusts, based on the comparison result in each of the evaluation charts, for each of positions of the evaluation charts, an amount of the displacement of the timing at which each of the light-emitting portions emits the light beam.

8. The image forming apparatus according to claim 7, wherein the control portion determines, with a center portion of each of the evaluation charts in the main scanning direction set to a reference position, the amount of the displacement of the timing at which each of the light-emitting portions emits the light beam.

9. The image forming apparatus according to claim 5, further comprising:

an intermediate transfer belt which is arranged opposite the image carrying member and on which the toner image on the image carrying member visualized by the developing portion is primarily transferred, wherein the density detection mechanism detects the image density in the evaluation chart primarily transferred on the intermediate transfer belt.

10. The image forming apparatus according to claim 5, further comprising:

a fixing device that fixes, on a recording medium, the toner image on the image carrying member visualized by the developing portion, wherein the density detection mechanism detects the image density in the evaluation chart fixed on the recording medium.

11. The image forming apparatus according to claim 1, wherein all the light beams emitted from the light-emitting portions are reflected off one of a plurality of deflection surfaces of the polygon mirror to form the evaluation chart.

12. The image forming apparatus according to claim 1, wherein the evaluation chart includes:

an identical surface first evaluation pattern that is the first evaluation pattern including the first evaluation patch which is formed by reflecting all the light beams emitted from the light-emitting portions off one of a plurality of deflection surfaces of the polygon mirror;

a different scanning surface first evaluation pattern that is the first evaluation pattern including the first evaluation patch which is formed by reflecting a part of the light beams emitted from the light-emitting portions off a first deflection surface among the plurality of deflection surfaces and reflecting the other light beams off a second deflection surface adjacent to the first deflection surface;

an identical surface second evaluation pattern that is the second evaluation pattern including the second evaluation patch which is formed by reflecting all the light beams emitted from the light-emitting portions off one of the plurality of deflection surfaces; and a different scanning surface second evaluation pattern that is the second evaluation pattern including the second evaluation patch which is formed by reflecting a part of the light beams emitted from the light-emitting portions off the first deflection surface among the plurality of deflection surfaces and reflecting the other light beams off the second deflection surface adjacent to the first deflection surface, wherein the control portion calculates an identical surface density difference that is a difference in development density between the identical surface first evaluation pattern and the identical surface second evaluation pattern, a different scanning surface density difference that is a difference in development density between the different scanning surface first evaluation pattern and the different scanning surface second evaluation pattern and a density difference correction value that is a value calculated from the identical surface density difference and the different scanning surface density difference, and the control portion corrects the difference values based on the density difference correction value to adjust timing at which each of the light-emitting portions emits the light beam.

* * * * *